US011254465B2

(12) United States Patent
Ford

(10) Patent No.: US 11,254,465 B2
(45) Date of Patent: Feb. 22, 2022

(54) CARTON WITH ATTACHMENT FEATURES

(71) Applicant: Graphic Packaging International, LLC, Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/931,539

(22) Filed: Jul. 17, 2020

(65) Prior Publication Data

US 2021/0016916 A1 Jan. 21, 2021

Related U.S. Application Data

(60) Provisional application No. 62/875,698, filed on Jul. 18, 2019.

(51) Int. Cl.
*B65D 5/42* (2006.01)
*B65D 5/54* (2006.01)

(52) U.S. Cl.
CPC ..... *B65D 5/427* (2013.01); *B65D 5/5495* (2013.01)

(58) Field of Classification Search
CPC .... B65D 5/427; B65D 5/5495; B65D 75/527; B31B 50/81; B65B 5/024; B65B 5/06
USPC ..... 229/120.011, 120.012; 206/192, 427, 206/736, 820; 493/137, 462, 84
See application file for complete search history.

(56) References Cited

U.S. PATENT DOCUMENTS 154,295 A 8/1874 Stone
1,120,752 A 12/1914 Smiley
1,147,651 A 7/1915 Scudder
1,230,675 A 6/1917 Cole
1,253,193 A 1/1918 Hill
1,896,326 A 2/1933 Northway-Ley
1,898,646 A 2/1933 Taylor
1,899,772 A * 2/1933 Richardson ..... B65D 5/5495 229/120.03
2,111,376 A 3/1938 Van Wingen
(Continued)

FOREIGN PATENT DOCUMENTS

CA 2 160 145 9/1995
CH 263456 8/1949
(Continued)

OTHER PUBLICATIONS

International Search Report and Written Opinion for PCT/US2020/042441 dated Oct. 30, 2020.

*Primary Examiner* — Christopher R Demeree
(74) *Attorney, Agent, or Firm* — Womble Bond Dickinson (US) LLP

(57) ABSTRACT

A carton for holding a plurality of containers includes a plurality of panels extending at least partially around an interior of the carton, the plurality of panels including a top panel, a bottom panel, and at least one side panel, and a plurality of end flaps foldably connected to a respective panel of the plurality of panels and forming at least one closed end of the carton, the plurality of end flaps including at least one top end flap, at least one bottom end flap, and at least one side end flap. The carton includes attachment features for attaching the carton to at least one other carton, the attachment features including at least one attachment flap removably connected to an end flap of the plurality of end flaps for attaching the carton to a portion of the at least one other carton.

45 Claims, 16 Drawing Sheets

(56) References Cited

U.S. PATENT DOCUMENTS 2,151,472 A 3/1939 Hubbard
2,312,846 A 3/1943 Olvey
2,475,107 A 7/1949 Newsom
2,594,376 A 4/1952 Arneson
2,758,774 A 8/1956 Grunert et al.
2,810,506 A 10/1957 Kessler
2,844,294 A 7/1958 Williams
2,854,050 A 9/1958 Di Padova
2,868,433 A 1/1959 Anderson, Jr.
2,875,942 A 3/1959 Wilson
2,955,739 A 10/1960 Collura
3,006,523 A 10/1961 Keith
3,027,063 A 3/1962 Zastrow
3,101,880 A 8/1963 Peterson
3,112,856 A 12/1963 MacIntosh et al.
3,127,720 A 4/1964 Gentry et al.
3,135,457 A * 6/1964 Risucci ..... B65D 5/5495 229/120.011
3,158,312 A 11/1964 Simkins
3,176,904 A 4/1965 Collura
3,204,814 A 9/1965 Mahon
3,289,914 A 12/1966 Lange-Wiehe
3,346,399 A 10/1967 Watson et al.
3,502,488 A 3/1970 Bridgford
3,531,045 A * 9/1970 Johnson ..... B65D 5/5445 229/240
3,664,494 A 5/1972 Mergens
3,732,976 A 5/1973 Bessett et al.
3,822,785 A 7/1974 Getz et al.
3,886,901 A 6/1975 Zeitter
3,937,326 A 2/1976 Schick
4,036,423 A 7/1977 Gordon
4,105,154 A 8/1978 Meyers et al.
4,120,443 A 10/1978 Gardner et al.
4,136,816 A 1/1979 Gardner
4,138,052 A 2/1979 Torigian
4,216,861 A 8/1980 Oliff
4,328,923 A 5/1982 Graser
4,378,905 A 4/1983 Roccaforte
4,421,229 A 12/1983 Pan et al.
4,467,923 A * 8/1984 Dornbusch ..... B65D 5/5495 206/192
4,498,619 A 2/1985 Roccaforte
4,530,459 A 7/1985 Maroszek
4,533,052 A * 8/1985 Fruchey ..... B65D 5/5495 206/805
4,546,914 A 10/1985 Roccaforte
4,577,799 A 3/1986 Oliff
4,588,084 A 5/1986 Holley, Jr.
4,621,766 A 11/1986 McClure
4,739,921 A 4/1988 Taub
4,747,487 A 5/1988 Wood
4,811,837 A 3/1989 Larizza
4,913,291 A 4/1990 Schuster
4,919,269 A 4/1990 Wright
4,979,669 A 12/1990 Kerton
5,020,337 A 6/1991 Krieg
5,056,710 A 10/1991 Ritter
5,076,492 A 12/1991 Tupes
5,094,359 A 3/1992 DeMars et al.
5,160,023 A 11/1992 Adams et al.
5,190,211 A 3/1993 Stoddard et al.
5,197,598 A 3/1993 Stout et al.
5,234,102 A 8/1993 Schuster et al.
5,246,112 A 9/1993 Stout et al.
5,246,113 A 9/1993 Schuster
5,292,058 A 3/1994 Zoss et al.
5,297,725 A 3/1994 Sutherland
5,299,733 A 4/1994 Werth
5,303,863 A 4/1994 Arasim
5,316,210 A 5/1994 Scullin
5,318,223 A * 6/1994 Gale ..... B65D 5/32 229/120.11
5,333,734 A 8/1994 Stout et al.
5,415,344 A 5/1995 Harrelson
5,427,242 A 6/1995 Cliff et al.
5,437,143 A 8/1995 Culpepper et al.
5,472,090 A 12/1995 Sutherland
5,495,727 A 3/1996 Strong et al.
5,518,111 A 5/1996 Stout
5,538,130 A 7/1996 Harrelson
5,551,566 A 9/1996 Sutherland
5,579,911 A * 12/1996 Werth ..... B65D 5/5495 206/192
5,582,343 A 12/1996 Dalvey
5,620,094 A 4/1997 Naumann
5,639,017 A 6/1997 Fogle
5,669,500 A 9/1997 Sutherland
5,682,984 A 11/1997 Hoell
5,699,957 A 12/1997 Blin et al.
5,704,470 A 1/1998 Sutherland
5,738,273 A 4/1998 Auclair
5,772,030 A 6/1998 Baxter
5,794,778 A 8/1998 Harris
5,813,540 A 9/1998 Vollbrecht et al.
5,826,782 A 10/1998 Stout
5,826,783 A 10/1998 Stout
5,826,870 A 10/1998 Vulgamore et al.
5,848,686 A 12/1998 Dean
5,853,088 A 12/1998 Saulas et al.
5,868,252 A 2/1999 Oliff
5,873,515 A 2/1999 Dunn et al.
5,915,546 A 6/1999 Harrelson
5,938,109 A 8/1999 Sainz et al.
5,957,288 A 9/1999 Campbell
5,967,406 A 10/1999 Moorman
5,992,733 A 11/1999 Gomes
5,996,883 A 12/1999 Bates
6,012,630 A 1/2000 Block
6,021,897 A 2/2000 Sutherland
6,065,590 A 5/2000 Spivey
6,085,969 A 7/2000 Burgoyne
6,112,977 A 9/2000 Sutherland et al.
6,164,526 A 12/2000 Dalvey
6,170,741 B1 1/2001 Skolik et al.
6,176,419 B1 1/2001 Holley, Jr.
6,227,367 B1 5/2001 Harrelson et al.
6,244,502 B1 6/2001 Hollar et al.
6,250,542 B1 6/2001 Negelen
6,302,320 B1 10/2001 Stout
D452,154 S 12/2001 Rhodes et al.
6,386,369 B2 5/2002 Yuhas et al.
6,402,020 B1 6/2002 McClure
6,631,803 B2 10/2003 Rhodes et al.
6,758,337 B2 7/2004 Chargueraud et al.
6,834,793 B2 12/2004 Sutherland
6,869,009 B2 3/2005 Sutherland et al.
6,913,189 B2 * 7/2005 Oliff ..... B65D 5/5495 229/120.011
6,918,487 B2 7/2005 Harrelson
6,926,193 B2 8/2005 Smalley
6,945,450 B2 9/2005 Rusnock
6,991,107 B2 1/2006 Harrelson
7,093,713 B2 8/2006 Sutherland
7,168,558 B2 1/2007 Harrelson
7,195,118 B2 3/2007 Sutherland
7,234,596 B2 6/2007 Lebras
7,270,259 B2 9/2007 Sutherland
7,296,731 B2 11/2007 Auclair et al.
7,380,701 B2 6/2008 Fogle et al.
7,416,109 B2 8/2008 Sutherland
7,475,778 B2 1/2009 Sutherland
7,578,427 B2 8/2009 Durnin
7,601,111 B2 10/2009 Sutherland et al.
7,699,215 B2 4/2010 Spivey, Sr.
7,717,321 B2 5/2010 Spivey, Sr. et al.
7,743,944 B2 6/2010 Ho Fung et al.
7,793,821 B2 9/2010 Oliveira
7,806,314 B2 10/2010 Sutherland
7,823,721 B2 11/2010 Sutherland et al.
7,832,622 B2 11/2010 Spivey, Sr.
8,109,433 B2 2/2012 De Paula et al.
8,127,980 B2 3/2012 Spivey, Sr. et al.

(56) References Cited

U.S. PATENT DOCUMENTS

| | | | | |
|---|---|---|---|---|
| 8,459,535 | B2 | 6/2013 | Brand | |
| 8,628,000 | B2 | 1/2014 | Spivey, Sr. et al. | |
| 8,752,755 | B2 | 6/2014 | DePaula et al. | |
| 9,132,936 | B2 | 9/2015 | Kohler | |
| 9,415,915 | B2 | 8/2016 | Spivey, Sr. et al. | |
| 10,017,293 | B2 | 7/2018 | Spivey, Sr. | |
| 10,501,226 | B2 | 12/2019 | Spivey, Sr. | |
| 2003/0080180 | A1 | 5/2003 | Holley et al. | |
| 2004/0155098 | A1 | 8/2004 | Harrelson | |
| 2004/0245327 | A1 | 12/2004 | Cliff et al. | |
| 2005/0023331 | A1 | 2/2005 | Hirschey | |
| 2005/0067477 | A1 | 3/2005 | McClure | |
| 2005/0115843 | A1 | 6/2005 | Harrelson | |
| 2005/0167290 | A1 | 8/2005 | Sutherland | |
| 2005/0167292 | A1 | 8/2005 | Sutherland | |
| 2005/0173269 | A1 | 8/2005 | Lebras | |
| 2005/0189406 | A1 | 9/2005 | Welchel et al. | |
| 2006/0071058 | A1 | 4/2006 | Spivey, Sr. | |
| 2006/0081690 | A1 | 4/2006 | Bates et al. | |
| 2006/0273143 | A1 | 12/2006 | Finch | |
| 2006/0283926 | A1 | 12/2006 | Drunin | |
| 2007/0051781 | A1 | 3/2007 | Holley, Jr. | |
| 2007/0164091 | A1 | 7/2007 | Fogle et al. | |
| 2007/0170232 | A1 | 7/2007 | Spivey | |
| 2007/0181658 | A1 | 8/2007 | Sutherland | |
| 2007/0284424 | A1 | 12/2007 | Holley | |
| 2008/0083820 | A1 | 4/2008 | Walling et al. | |
| 2008/0119344 | A1 | 5/2008 | Sutherland et al. | |
| 2009/0255983 | A1 | 10/2009 | De Paula et al. | |
| 2009/0282843 | A1 | 11/2009 | Brand | |
| 2009/0308915 | A1 | 12/2009 | Brand | |
| 2010/0200646 | A1 | 8/2010 | Miller | |
| 2011/0132978 | A1 | 6/2011 | de Sousa | |
| 2013/0256392 | A1 | 10/2013 | Kohler | |
| 2017/0190461 | A1* | 7/2017 | Spivey, Sr ..... | B65D 5/02 |

FOREIGN PATENT DOCUMENTS

| | | | |
|---|---|---|---|
| DE | 88 14 144.6 | | 1/1989 |
| DE | 91 11 941.3 | | 1/1992 |
| DE | 20 2004 018 649 | | 4/2005 |
| EP | 0 412 226 | | 2/1991 |
| EP | 0 595 602 | | 5/1994 |
| FR | 1427897 | | 4/1966 |
| FR | 1489087 | | 7/1967 |
| FR | 1494239 | | 9/1967 |
| FR | 1497652 | | 10/1967 |
| FR | 2223985 | | 10/1974 |
| FR | 2579175 | | 9/1986 |
| FR | 2626256 | | 7/1989 |
| GB | 434145 | | 8/1935 |
| GB | 2 198 709 | | 6/1988 |
| GB | 2 323 352 | | 9/1998 |
| JP | 60-57517 | | 4/1985 |
| JP | 62-62617 | | 10/1985 |
| JP | 62-130024 | | 8/1987 |
| JP | 1-73121 | | 5/1989 |
| JP | 5-7621 | | 2/1993 |
| JP | 5-35630 | | 5/1993 |
| JP | 7-125745 | | 5/1995 |
| JP | 9-142449 | | 6/1997 |
| JP | 9-207934 | | 8/1997 |
| JP | 11-130049 | | 5/1999 |
| JP | 2000-85754 | | 3/2000 |
| JP | 2000-238779 | | 9/2000 |
| JP | 2002-526346 | | 8/2002 |
| JP | 2005-104548 | | 4/2005 |
| JP | 2006-168791 | | 6/2006 |
| JP | 2011-516360 | A | 5/2011 |
| KR | 20-0356729 | | 7/2004 |
| WO | WO 92/07772 | | 5/1992 |
| WO | WO 96/29261 | | 9/1996 |
| WO | WO 98/56684 | | 12/1998 |
| WO | WO 99/28198 | | 6/1999 |
| WO | WO 00/20288 | | 4/2000 |
| WO | WO 01/30659 | | 5/2001 |
| WO | WO 02/30764 | | 4/2002 |
| WO | WO 2004/014755 | | 2/2004 |
| WO | WO 2007/089282 | | 8/2007 |
| WO | WO 2009/129201 | A2 | 10/2009 |
| WO | WO 2016/144666 | A1 | 9/2016 |

* cited by examiner

CARTON WITH ATTACHMENT FEATURES

CROSS-REFERENCE TO RELATED APPLICATION

This application claims the benefit of U.S. Provisional Patent Application No. 62/875,698, filed on Jul. 18, 2019.

INCORPORATION BY REFERENCE

The disclosure of U.S. Provisional Patent Application No. 62/875,698, filed on Jul. 18, 2019, is hereby incorporated by reference as if presented herein in its entirety.

BACKGROUND OF THE DISCLOSURE

The present disclosure generally relates to cartons for holding beverage containers or other types of articles. More specifically, the present disclosure relates to cartons configured with one or more attachment features that attach to at least one other carton.

SUMMARY OF THE DISCLOSURE

According to one aspect of the disclosure, a carton for holding a plurality of containers can comprise a plurality of panels extending at least partially around an interior of the carton, the plurality of panels comprising a top panel, a bottom panel, and at least one side panel. A plurality of end flaps can be foldably connected to a respective panel of the plurality of panels and forming at least one closed end of the carton, the plurality of end flaps comprising at least one top end flap, at least one bottom end flap, and at least one side end flap. Attachment features for attaching the carton to at least one other carton can comprise at least one attachment flap removably connected to an end flap of the plurality of end flaps for attaching the carton to a portion of the at least one other carton.

According to another aspect of the disclosure, a blank for forming a carton for holding a plurality of containers can comprise a plurality of panels for extending at least partially around an interior of the carton formed from the blank, the plurality of panels comprising a top panel, a bottom panel, and at least one side panel. A plurality of end flaps foldably connected to a respective panel of the plurality of panels and for forming at least one closed end of the carton formed from the blank can comprise at least one top end flap, at least one bottom end flap, and at least one side end flap. Attachment features for removably connecting the carton formed from the blank to at least one other carton can comprise at least one attachment flap removably connected to an end flap of the plurality of end flaps for attaching the carton from the blank to a portion of the at least one other carton.

According to another aspect of the disclosure, a method of forming a carton for holding a plurality of containers can comprise obtaining a blank comprising a plurality of panels comprising a top panel, a bottom panel, and at least one side panel, a plurality of end flaps comprising at least one top end flap, at least one bottom end flap, and at least one side end flap, and attachment features comprising at least one attachment flap removably connected to an end flap of the plurality of end flaps. The method can further comprise folding the plurality of panels at least partially around an interior of the blank, folding the plurality of end flaps to form at least one closed end of the carton, and attaching the at least one attachment flap to a portion of at least one other carton.

According to another aspect of the disclosure, a system of cartons for holding a plurality of containers can comprise a first carton attached to a second carton, the first carton comprising a plurality of panels extending at least partially around an interior of the first carton, the plurality of panels comprising a top panel, a bottom panel, and at least one side panel. A plurality of end flaps foldably connected to a respective panel of the plurality of panels and forming at least one closed end of the first carton can comprise at least one top end flap, at least one bottom end flap, and at least one side end flap, and attachment features removably connecting the first carton to the second carton can comprise at least one attachment flap removably connected to an end flap of the plurality of end flaps and attached to a portion of the second carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure generally relates to cartons that contain articles, for example, containers such as bottles, cans, etc. The articles can be used, for example, for packaging food and beverage products. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum cans or glass beverage bottles) as disposed within the carton embodiments. In this specification, the terms "inner," "outer," "lower," "bottom," "upper," and "top" indicate orientations determined in relation to fully erected and upright cartons.

As described herein, cartons may be formed by multiple overlapping panels, portions, and/or end flaps. Such panels, portions, and/or end flaps may be designated in relative terms to one another, e.g., "first", "second", "third", etc., in sequential or non-sequential reference, without departing from the disclosure.

Figure 1:
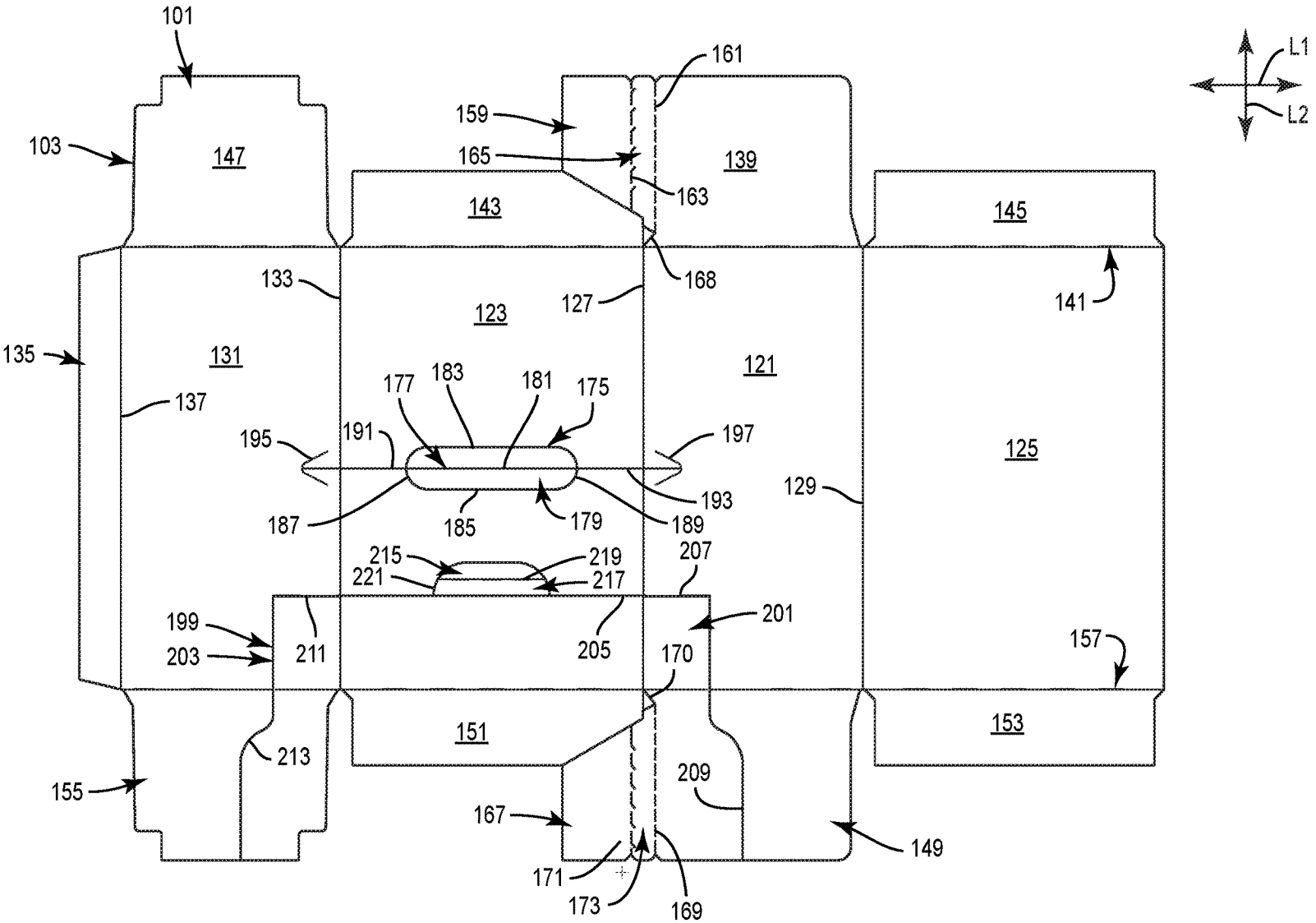
FIG. 1 is a plan view of a blank for forming a carton according to a first exemplary embodiment of the disclosure.

FIG. 1 is a plan view of the exterior side 101 of a blank, generally indicated at 103, used to form a carton 105 (FIG. 4) (broadly, "first carton") according to a first exemplary embodiment of the disclosure. The carton 105 can be used to hold a plurality of articles such as containers in the form of beverage cans. The carton 105 includes attachment features for engaging at least one other carton, e.g., another similarly-configured carton or a carton of a different configuration, such that the carton 105 can be provided as part of a series or system of joined cartons. Such an attachable configuration of the carton 105 can allow for a plurality of joined cartons, e.g., as a system or multipack of individual cartons, so that additional accessories for bundling or attaching multiple cartons, e.g., plastic overwraps or sheets, additional outer container structures, bands or straps, etc., can be reduced or obviated.

The blank 103 has a longitudinal axis L1 and a lateral axis L2. In the illustrated embodiment, the blank 103 comprises a top panel 121 foldably connected to each of a first side panel 123 and a second side panel 125 at respective lateral fold lines 127, 129. A bottom panel 131, as shown, is foldably connected to the first side panel 123 at a lateral fold line 133. An adhesive flap 135 can be provided foldably connected to the bottom panel 131 at a lateral fold line 137, and can be provided with an adhesive, such as glue, to facilitate formation of the carton 105, as described further herein. The flap 135 can be attached to one or more other portions of the carton 105 through a different attachment medium without departing from the disclosure.

Still referring to FIG. 1, the blank 103 comprises a plurality of end flaps that includes a top end flap 139 (broadly, "first top end flap" or "second top end flap") foldably connected to the top panel 121 at a respective portion of a longitudinal fold line 141, a first side end flap 143 foldably connected to the first side panel 123 at a respective portion of the fold line 141, a second side end flap 145 foldably connected to the second side panel 125 at a respective portion of the fold line 141, and a bottom end flap 147 foldably connected to the bottom panel 131 at a respective portion of the fold line 141. The end flaps 139, 143, 145, 147 are a plurality of end flaps extending along a first marginal portion of the blank 103 for forming a closed end 109 (broadly, "first closed end" or "second closed end") of the carton 105, and the blank 103 further comprises a plurality of end flaps 149, 151, 153, 155 extending along a second marginal portion of the blank 103 for forming a closed end 11 (broadly, "first closed end" or "second closed end") of the carton 105 opposite the closed end 109.

As shown, the top end flap 149 (broadly, "first top end flap" or "second top end flap") is foldably connected to the top panel 121 at a respective portion of a longitudinal fold line 157, the first side end flap 151 is foldably connected to the first side panel 123 at a respective portion of the fold line 157, the second side end flap 153 is foldably connected to the second side panel 125 at a respective portion of the fold line 157, and the bottom end flap 155 is foldably connected to the bottom panel 31 at a respective portion of the fold line 157.

As also shown, a first securing flap or first attachment flap 159 (broadly, "second attachment flap") extends away from the top end flap 139 and is removably, e.g., separably, connected thereto at a tear line 161 (broadly, "first tear line"). A tear line 163 (broadly, "second tear line") is provided spaced away from the tear line 161 to define a tear strip 165 therebetween such that the attachment flap 159 is removably attached to the tear strip 165 at the tear line 163 and such that the tear strip 165 is removably connected to the top end flap 139 at the tear line 161.

Similarly, a second securing flap or second attachment flap 167 (broadly, "first attachment flap") extends away from the top end flap 149 and is removably connected thereto at a tear line 169 (broadly, "first tear line"), and a tear line 171 (broadly, "second tear line") is provided spaced apart from the tear line 169 to define a tear strip 173 therebetween such that the attachment flap 167 is removably attached to the tear strip 173 at the tear line 171 and the such that tear strip 173 is removably connected to the top end flap 149 at the tear line 169. One or more of the attachment flaps 159, 167 can be attachment features of the blank 103/carton 105 and one or more of the tear strips 165, 173, and associated respective tear lines 161, 163, 169, 171 between the attachment flaps 159, 167 and respective end flaps 139, 149 can be separation features of the blank 103/carton 105, as described further herein.

In one embodiment, the tear strips 165, 173 can be considered a part of the respective attachment flaps 159, 167. In another embodiment, the tear strips 165, 173 can be considered distinct from the respective attachment flaps 159, 167. As also shown, respective angled relief cuts 168, 170 can be provided at free edge portions of the respective top end flaps 139, 149 for facilitating manipulation of the top end flaps 139, 149 upon formation of the carton 105.

With continued reference to FIG. 1, the blank 103/carton 105 includes handle features that form a handle 175 of the carton 105. The handle features include handle flaps 177, 179 separated by a longitudinal cut 181 and that are foldably connected to the side panel 123 at respective longitudinal fold lines 183, 185. The handle flaps 177, 179 can be at least partially defined by respective curved cuts 187, 189 that extend from one respective endpoint of the respective fold lines 183, 185 to the other respective endpoint of the fold lines 183, 185. The handle features can also include respective longitudinal relief cuts 191, 193 that extend away from respective endpoints of the cut 181, across the respective fold lines 133, 127, and into a portion of the respective bottom panel 131 and top panel 121. A respective curved or angled crease or line of weakening 195, 197 can be positioned on the respective bottom panel 131 and top panel 121 to intersect a respective endpoint of the respective relief cuts 191, 193 at a respective apex thereof.

The blank 103/carton 105 also includes dispenser features for forming a dispenser 199 in at least one closed end of the carton 105. The dispenser 199 includes a dispenser panel 201 that includes portions of each of the top panel 121, the first side panel 123, the bottom panel 131, the top end flap 149, the attachment flap 167/tear strip 173, the first side end flap 151, and the bottom end flap 155.

The dispenser panel 201 is defined by a dispenser tear line 203 that includes a first portion 205 in the first side panel 123 that intersects a second portion 207 in the top panel 121, and a third portion 209 in the top end flap 149 that intersects the second portion 207. The dispenser tear line 203 also includes a fourth portion 211 in the bottom panel 131 that intersects the first portion 205 and a fifth portion 213 in the bottom end flap 155 that intersects the fourth portion 211. As shown, the portions 205, 207, 209, 211, 213 of the dispenser tear line 203 can include one or more of straight (e.g., longitudinal, lateral, oblique) sections, curved sections, or angled sections therealong.

A pair of access flaps 215, 217 can be foldably or removably connected to the top panel 121 at a respective longitudinal fold line 219 and a portion of the first portion 205 of the dispenser tear line 203. The access flaps 215, 217 can be separated by a longitudinal cut 219 and can each be at least partially defined by a respective portion of a curved line of weakening 221 having endpoints that intersect the first portion 205 of the dispenser tear line 203.

The panels and flaps of the blank 103 could be omitted or could be otherwise shaped, arranged, configured and/or positioned without departing from the disclosure.

Figure 2:
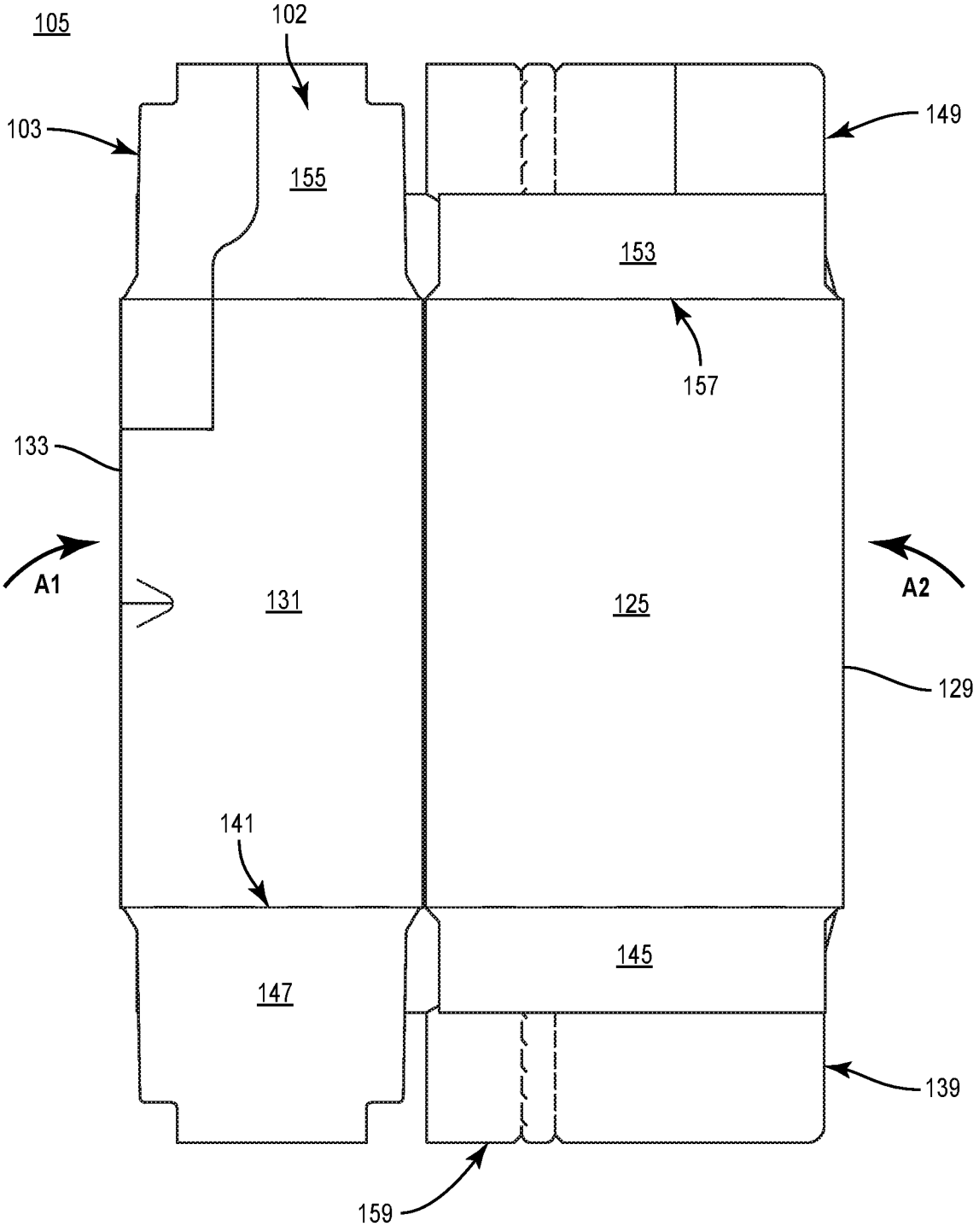
FIG. 2 is a plan view of a partially-folded configuration of a carton formed from the blank of FIG. 1.
Figure 3:
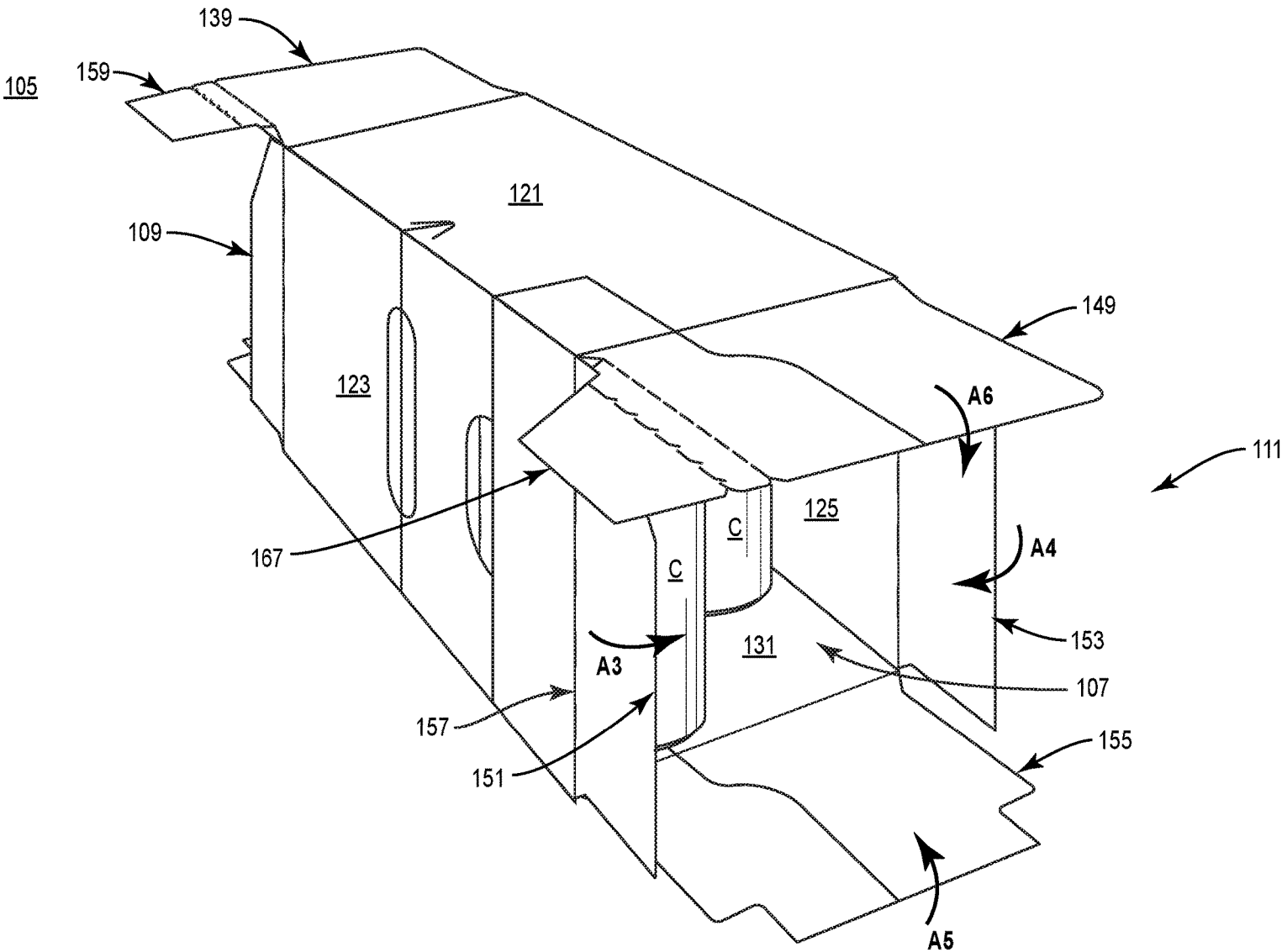
FIG. 3 is a perspective view of a carton formed from the blank of FIG. 1 and in an open configuration according to the first exemplary embodiment of the disclosure.
Figure 4:
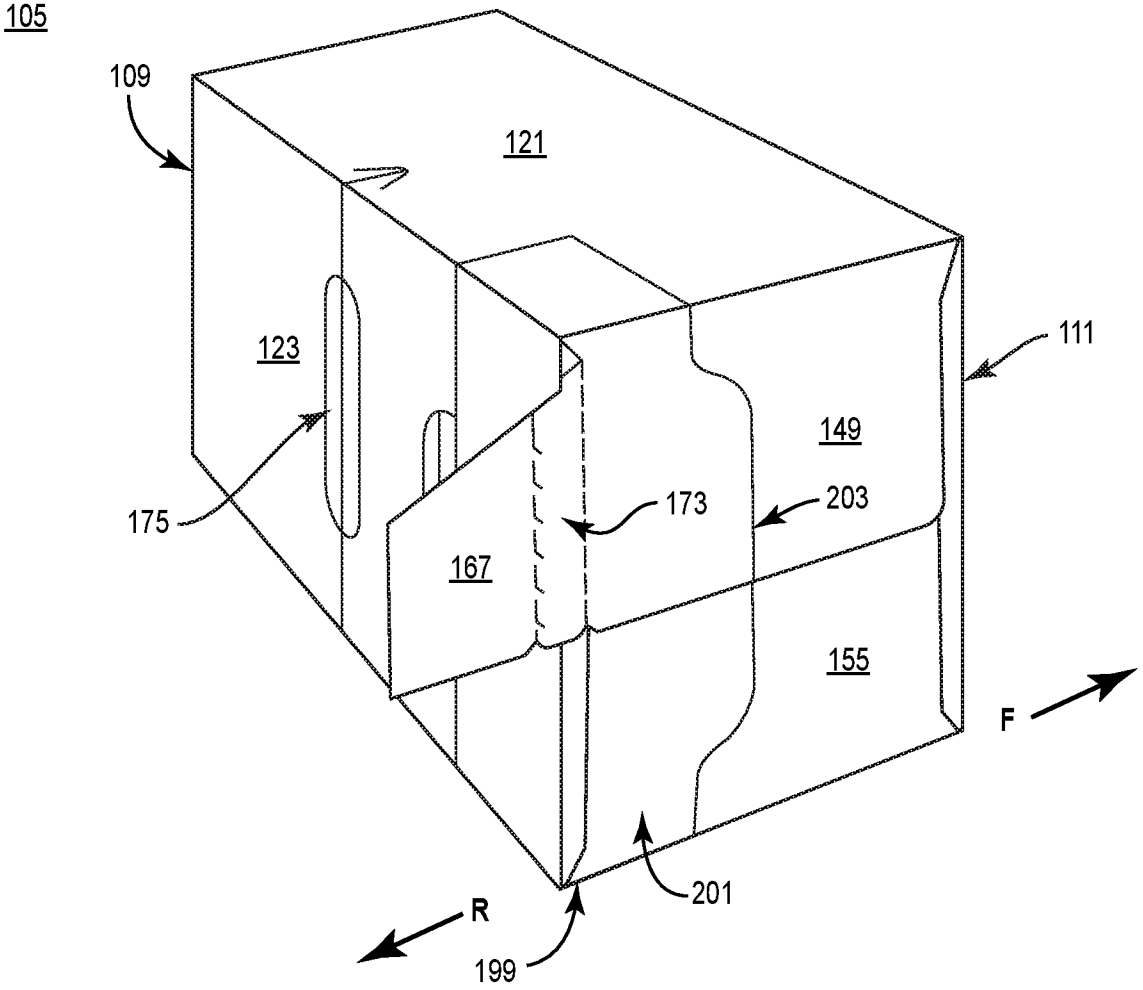
FIG. 4 is a perspective view of a carton formed from the blank of FIG. 1 and in a closed configuration according to the first exemplary embodiment of the disclosure.

Referring additionally to FIGS. 2-4, formation of the carton 105 from the blank 103 according to one exemplary embodiment of the disclosure will be described. The blank 103 can be obtained and positioned in a face down orientation, i.e., with the exterior surface 101 facing downwardly and with an interior surface 102 thereof facing upwardly. The bottom panel 131 can be folded at the fold line 133 in the direction of the arrow A1 such that the bottom panel 131 is positioned in at least partial face-to-face contact with a portion of the first side panel 123 and such that the adhesive flap 135 is carried into at least partial face-to-face contact with a portion of the first side panel 123.

Simultaneously or thereafter, the second side panel 125 can be folded at the fold line 129 in the direction of the arrow A2 into at least partial face-to-face contact with respective portions of the top panel 121, the first side panel 123, and the adhesive flap 135. Such folded arrangement of the blank 103/collapsed arrangement of the carton 105 illustrated in FIG. 2 can be maintained with an adhesive, for example, glue.

As shown in FIG. 3, the carton 105 can be manipulated into an erected, open-sleeve configuration, for example, by one or more machine components and/or an operator, such that the top panel 121 and the bottom panel 131 are in spaced, parallel relation, and such that the first side panel 123 and the second side panel 125 are in spaced parallel relation and extend perpendicularly relative to the top panel 121 and the bottom panel 131. In such an arrangement, the panels 121, 123, 125, 131 define and extend at least partially around an interior 107 of the carton 105 into which one or more containers C can be loaded in a desired arrangement.

As shown in FIGS. 3 and 4, 1 to effect closure of the first end 111 of the carton 5, the side end flaps 151, 153 can be folded at respective portions of the fold line 157 in the direction of the respective arrows A3, A4, and the bottom end flap 155 can thereafter be folded at a respective portion of the fold line 157 in the direction of the arrow A5. Simultaneously or thereafter, the top end flap 149 can be folded at a respective portion of the fold line 157 in the direction of the arrow A6 such that the attachment flap 167 extends longitudinally away from the end 111 of the carton 105. In one embodiment, the attachment flap 167 can extend longitudinally away from the end of the carton 105 in a rearward or trailing direction R, e.g., a direction opposite a direction of motion of the carton 105 on a component of a forming and/or loading apparatus, such as a conveyor.

The second end 109 of the carton 105 can be closed in a similar manner as the second end 111 of the carton 105, with the side end flaps 143, 145 folded at respective portions of the fold line 141, the bottom end flap 147 folded at a respective portion of the fold line 141, and the top end flap 139 be folded at a respective portion of the fold line 141 such that the attachment flap 159 extends longitudinally away from the end 109 of the carton 105 in the trailing direction R and in parallel with the attachment flap 159.

The above-described closed configuration of the carton 105 can be maintained with one or more applications of adhesive, for example, glue. It will be understood that the carton 105 can be formed through a different sequence without departing from the disclosure.

The aforementioned configuration of the carton 105 provides the attachment flaps 159, 167 extending away from the main body and closed ends 109, 111 of the carton 105 so as to be free for attachment to another carton, e.g., another carton 105 and/or another differently-configured carton, as described further herein.

Figure 5:
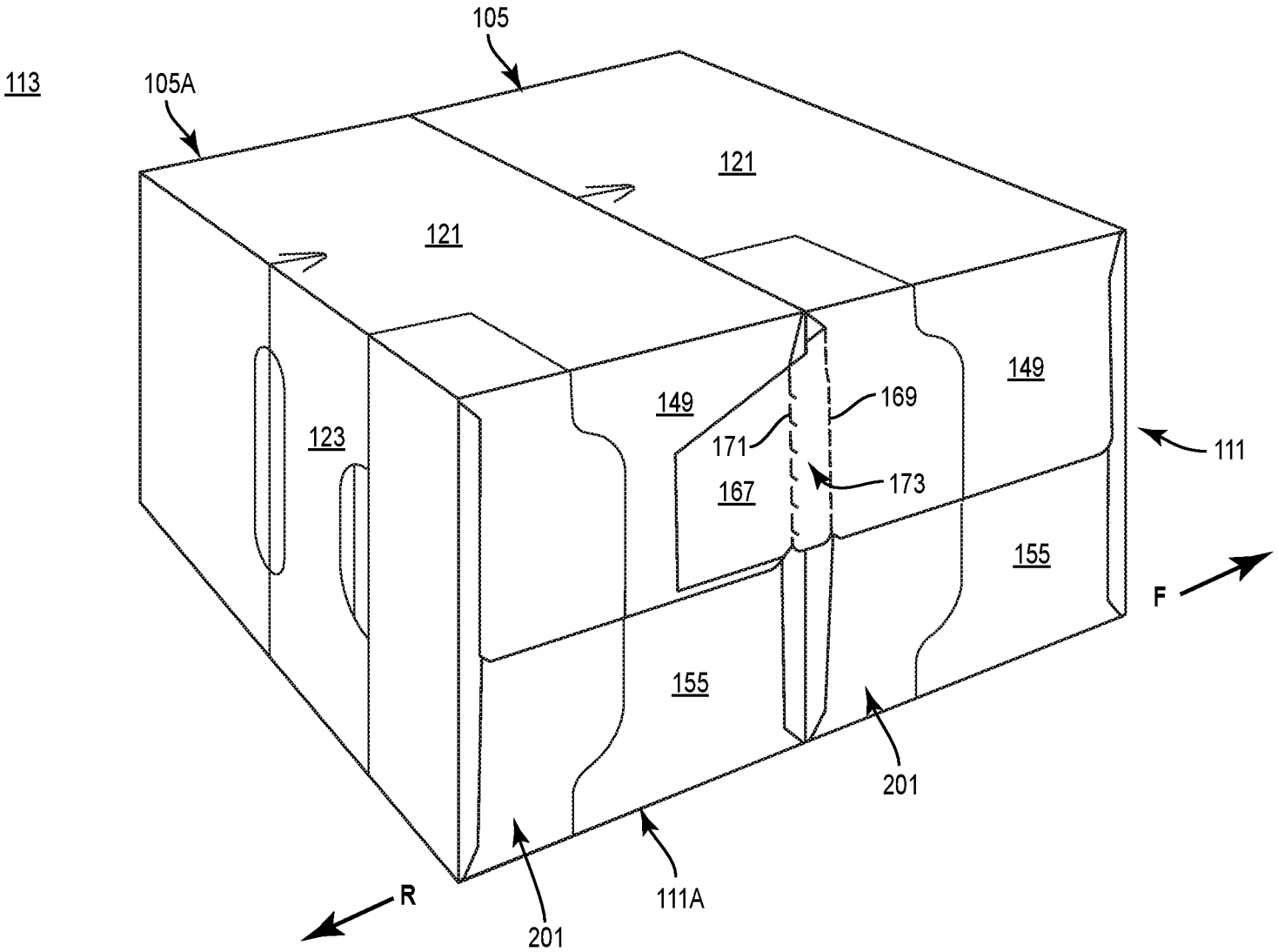
FIG. 5 is a perspective view of a system including the carton of FIG. 4 attached to an alternative configuration of the carton of FIG. 4, according to the first exemplary embodiment of the disclosure.

Referring additionally to FIG. 5, an alternative configuration of the carton 105, generally designated 105A (broadly, "second carton"), can be formed by an alternative folding of the respective end flaps 139, 143, 145, 147 and end flaps 149, 151, 153, 155 that form the respective ends 109, 111.

However, prior to or during folding of the top end flap 149 at the respective portion of the fold line 157, the attachment flap 167 can further be folded at the tear line 169 or the tear line 171 such that the attachment flap 167 is tucked under, e.g., in at least partial face-to-face contact with, the top end flap 149 in the closed end 111A of the carton 105A. In such an arrangement, the attachment flap 167 can be positioned between the top end flap 149 and the side end flap 151.

The closed end 109A of the carton 105A can be formed in a similar manner as the closed end 111A described above, for example, by folding the side end flaps 139, 143, 145, 147 at respective portions of the fold line 141, and, prior to or during folding of the top end flap 139 at the respective portion of the fold line 141, the attachment flap 159 can further be folded at the tear line 161 or the tear line 163 such that the attachment flap 167 is tucked under, e.g., in at least partial face-to-face contact with, the top end flap 139 in the closed end 109A of the carton 105A. In such an arrangement, the attachment flap 159 can be positioned between the top end flap 139 and the side end flap 143.

In this regard, the carton 105A is provided with the same features but an alternative configuration as to compared to the carton 105, i.e., such that the attachment flaps 159, 167 are tucked within and do not extend away from the main body/closed ends 109A, 111A of the carton 105A. Accordingly, and as described further herein, in a multipack or a system comprising a plurality of joined cartons, the carton 105A can be provided as a rearmost or trailing carton 105A and attached to one or more forwardly positioned cartons 105. The substantially compact configuration of the carton 105A, e.g., lacking any flaps extending away from the main body or closed ends thereof, provides an ideal trailing end component to the system that is both aesthetically appealing and that does not present extending features that could potentially obstruct machine, transport, or storage operations. Further, a carton 105 can be provided in a system as a leading carton, i.e., a carton 105 positioned relative to the carton 105A along a leading direction F that is in the direction of motion of the cartons and that is opposite the trailing direction R.

Figure 6:
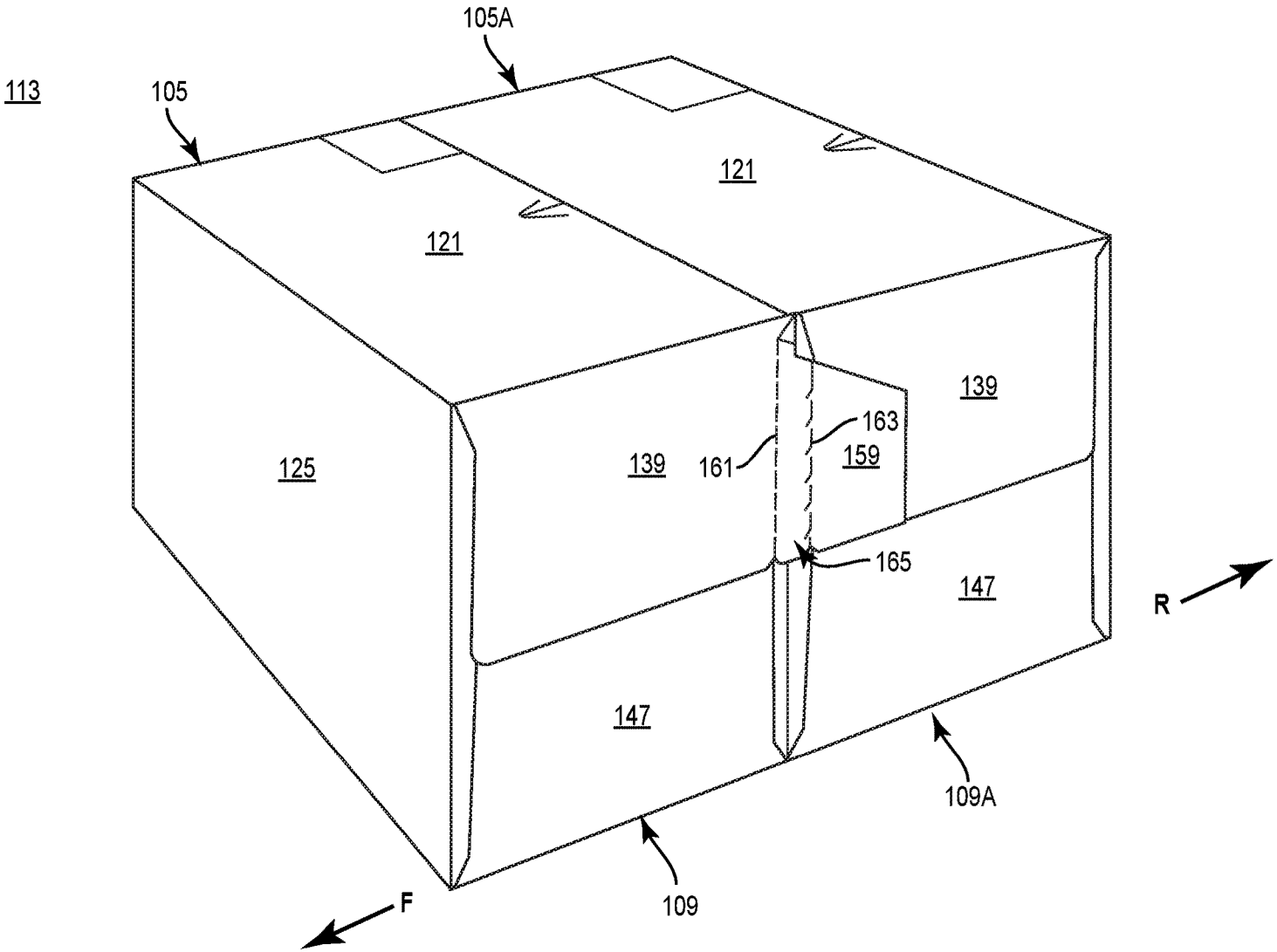
FIG. 6 is another perspective view of the system of FIG. 5.

Referring additionally to FIGS. 5 and 6, a system 113 of joined cartons 105, 105A is illustrated according to one exemplary embodiment of the disclosure. As shown, the longitudinally-rearward extending, e.g., in the trailing direction R, attachment flaps 159, 167 of a leading carton 105 can be attached to the respective ends 109A, 111A of the trailing carton 105A, for example, with an adhesive such as glue. The attachment flaps 159, 167 of the leading carton 105 can be attached to the respective top end flaps 139, 149 of the trailing carton 105A. In one embodiment, the attachment flaps 159, 167 can be attached to the exterior surface of the respective top end flaps 139, 149 of the trailing carton 105A. In another embodiment, the attachment flaps 159, 167 can be at least partially tucked into and attached the respective ends 109A, 111A of the trailing carton 105A. For example, the attachment flaps 159, 167 of the leading carton 105 can be positioned between the respective top end flaps 139, 149 and the respective side end flaps 145, 153 of the trailing carton 105A.

While a system 113 has been illustrated as comprising a trailing carton 105A attached to a leading carton 105, it will be understood that the system 113 can include a different number or arrangement of cartons without departing from the disclosure. For example, one or more additional cartons 105 can be attached between the trailing carton 105A and the leading carton 105. In one embodiment, one or more differently-configured cartons can be disposed between the trailing carton 105A and the leading carton 105.

Figure 7:
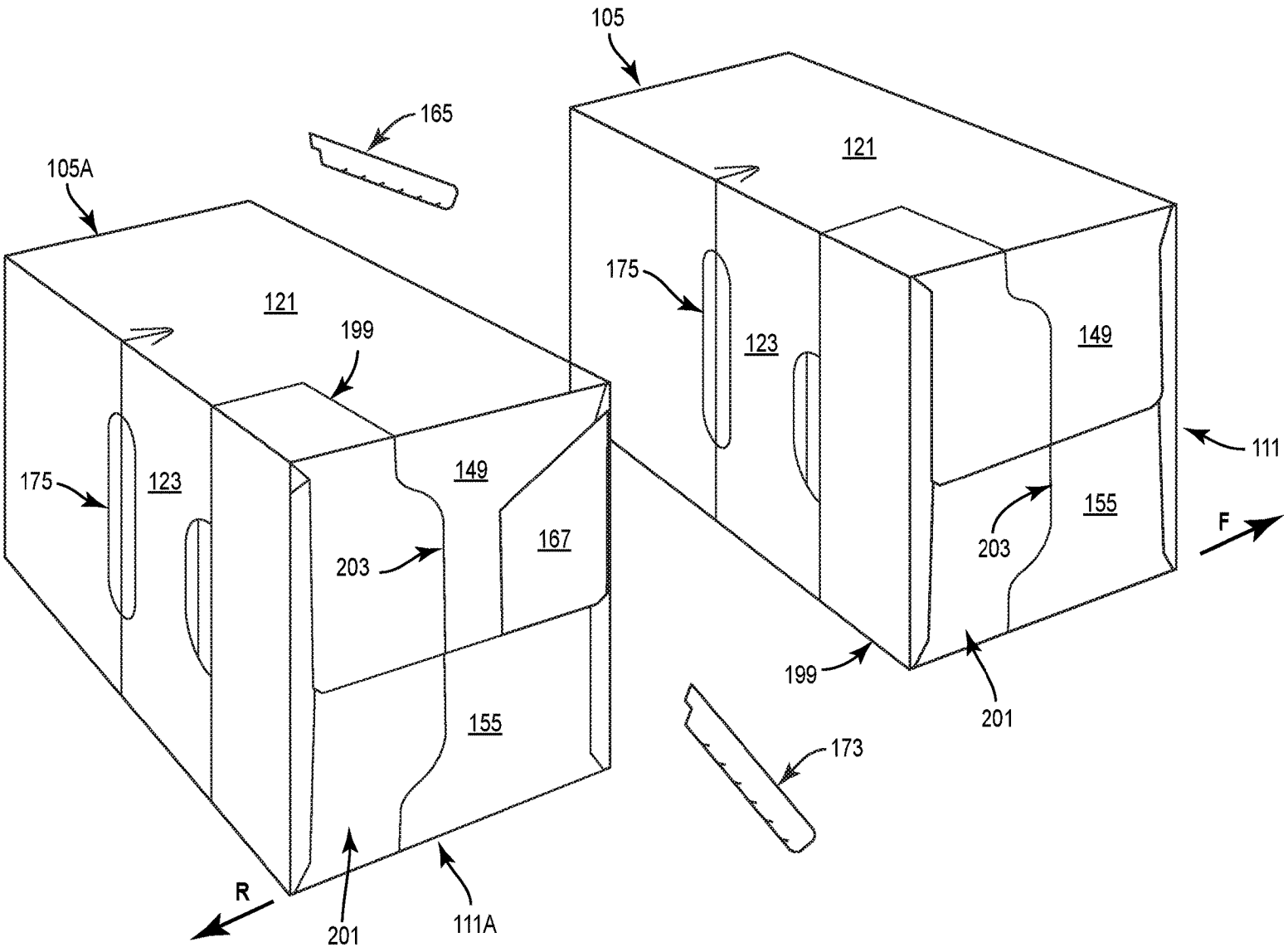
FIG. 7 is a perspective view of the cartons of the system of FIG. 5 being separated from one another.

Upon formation of a system 113 as described herein, and with additional reference to FIG. 7, one or more of the constituent cartons 105, 105A can be separated therefrom via the separation features of the respective carton 105, 105A. For example, and as shown, the tear strips 165, 173 of the leading carton 105 can be removed, e.g., by tearing along the respective tear lines 161, 163 and tear lines 169, 171 such that the attachment flaps 159, 167 remain attached to the respective ends 109A, 111A of the trailing carton 105A and such that the carton 105 and the carton 105A are thereby separated from one another. It will be understood that the system 113 can be separated in a different arrangement, for example, by tearing at one tear line of the respective pairs of tear lines 161, 163 and tear lines 169, 171, such that the respective tear strip 165, 173 remains attached to the respective attachment flap 159, 167 or the respective top end flap 139, 149 of the leading carton 105.

Upon separation of the cartons 105, 105A from the system 113, or upon obtaining one or both of the cartons 105, 105A separately, a customer can activate the handle features to grasp a portion of the handle 175 for lifting and carrying the respective carton 105, 105A. Such activation of the handle features can include separation of one or both of the handle flaps 177, 179 from each other and from the side panel 123 at the respective cuts 181, 187, 189, 191, 193. One or both of the handle flaps 177, 179 can be folded downwardly at the respective fold lines 183, 185 to provide a handle opening through which a customer can insert his or her fingers at least partially into the interior 107 of the respective carton 105, 105A to grasp an adjacent portion of the side panel 123.

Should a customer desire to access containers C in the interior 107 of the respective carton 105, 105A, the respective dispenser features can be activated. For example, one or both of the access flaps 215, 217 can be separated from each other and the remainder of the top panel 121 at the respective cuts 219, 221 to provide an access opening through which a customer can insert his or her fingers at least partially into the interior 107 of the carton 105/105A to grasp an adjacent portion of the dispenser panel 201. The customer can pull the dispenser panel 201 away from the carton 105/105A such that the dispenser panel 201 separated from the carton 105/105A along respective portions of the dispenser tear line 203 to create a dispenser opening through which one or more containers C can be withdrawn from the interior 107 of the carton 105/105A. Such dispenser opening is positioned in a corner portion of the carton 105/105A between portions of the top panel 121, side panel 123, and bottom panel 131, and a respective portion of the closed end 111/111A of the carton 105/105A.

Figure 8:
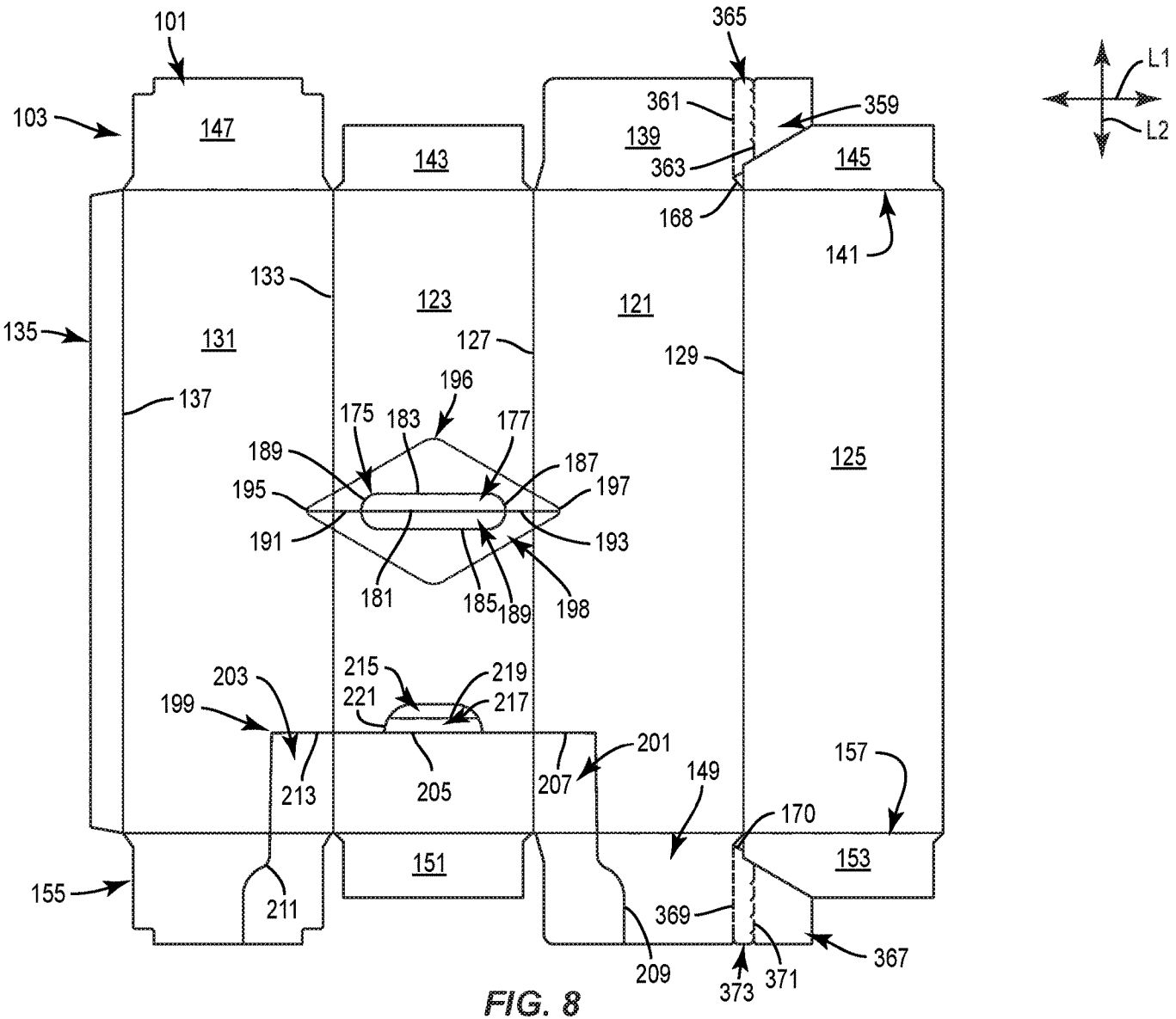
FIG. 8 is a plan view of a blank for forming a carton according to a second exemplary embodiment of the disclosure.

Referring additionally to FIG. 8, a blank for forming a carton 305 (broadly, "first carton") or a carton 305A (broadly, "second carton") according to a second exemplary embodiment of the disclosure is generally designated 303. The blank 303/carton 305/carton 305A has one or more features that are substantially similar to the blank 103/carton 105/carton 105A of the first exemplary embodiment, and like or similar features are designated with like or similar reference numbers.

As shown, the blank 303, in contrast to the blank 103, is devoid of the attachment flaps 259, 267 and instead includes a pair of attachment flaps 359, 367 (broadly, respective "first attachment flap" or "second attachment flap") removably connected to the respective top end flaps 139, 149 at respective tear lines 361, 369 (broadly, respective "first tear line"). Tear lines 363, 371 (broadly, respective "second tear line") are spaced apart from the respective tear lines 361, 369 to define tear strips 365, 373 therebetween such that the respective attachment flaps 359, 367 are removably attached to the respective tear strips 365, 373 at the respective tear lines 363, 371 and the tear strips 365, 373 are removably connected to the respective top end flaps 139, 149 at the respective tear lines 361, 369. The attachment flaps 359, 367 and the tear strips 365, 373 are substantially similar to but are lateral mirror-images of the respective attachment flaps 159, 167 and respective tear strips 165, 173, one or more of the attachment flaps 359, 367 forming attachment features of the blank 303/carton 305 and one or more of the tear strips 365, 373 and associated tear lines forming separation features of the blank 303/carton 305.

The blank 303 can also include additional handle features in the form of a pair of creases or other lines of weakening 196, 198 that at least partially surround the remaining handle features, e.g., to facilitate at least partial reconfiguration of the side panel 123 upon carrying of the carton 305 at the handle 175.

In this regard, the carton 305 can be formed from the blank 303 in a manner similar to that described above with respect to the carton 105 and the blank 103, and such that the respective closed ends 309, 311 (broadly, respective "first closed end" or "second closed end") of the carton 305 are formed with the respective attachment flaps 359, 367 extending longitudinally away therefrom in the leading direction F.

Similarly, a leading carton 305A can be formed by folding the respective attachment flaps 359, 367 at one of the respective fold lines 361, 363 and fold lines 369, 371 to be tucked under the respective top end flaps 139, 149 as described above with respect to the carton 105A.

Figure 9:
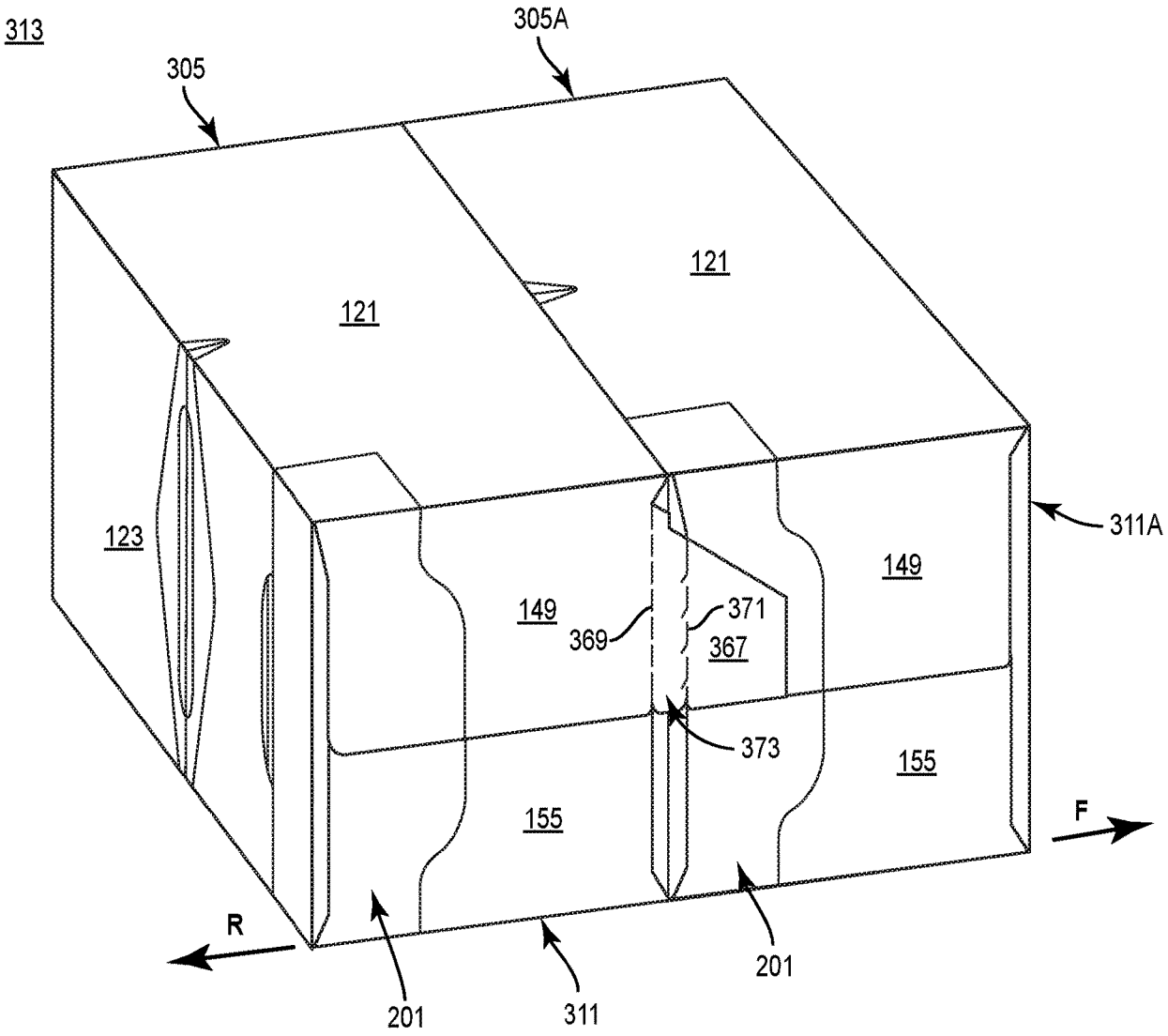
FIG. 9 a perspective view of a system including a carton formed from the blank of FIG. 8 attached to an alternative configuration of the carton formed from the blank of FIG. 8, according to the second exemplary embodiment of the disclosure.
Figure 10:
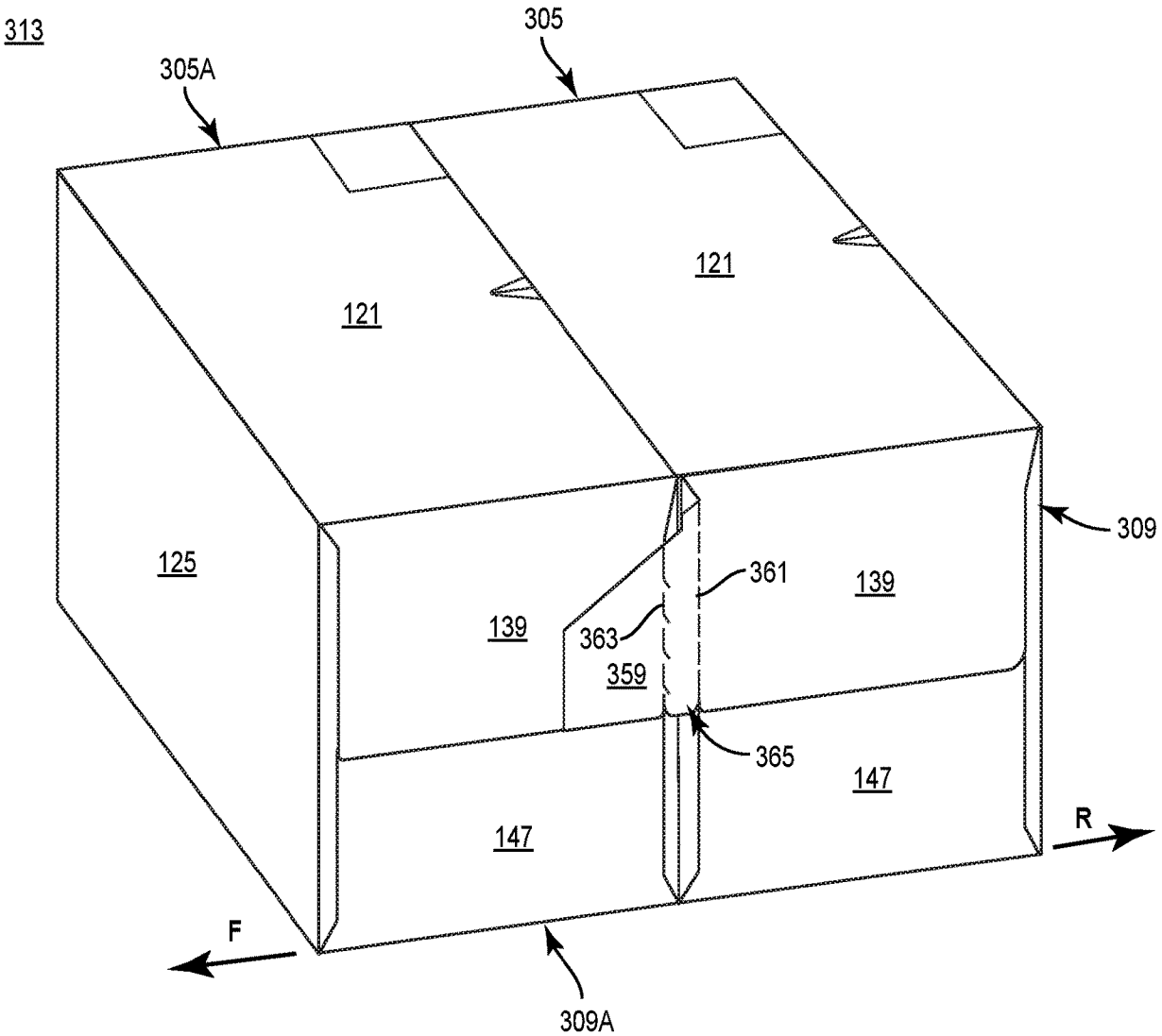
FIG. 10 is another perspective view of the system of FIG. 9.

Accordingly, and with additional reference to FIGS. 9 and 10, a system 313 of cartons 305, 305A is illustrated according to the second exemplary embodiment of the disclosure. In the system 313, the carton 305A can be positioned as a forward-most or leading carton with a substantially compact main body, and the one or more trailing cartons 305 provide the longitudinally-forward extending attachment flaps 359, 367 that can be attached to the respective ends 309A, 311A of the forwardly-adjacent carton 305, 305A, e.g., a portion of a respective top end flap 139, 149. With regard to a top end flap 149, such portion can at least partially include the dispenser panel 201.

While a system 313 has been illustrated as comprising a trailing carton 305 attached to a leading carton 305A, it will be understood that the system 313 can include a different number or arrangement of cartons without departing from the disclosure. For example, one or more additional cartons 305 can be attached between the trailing carton 305 and the leading carton 305A. In one embodiment, one or more differently-configured cartons can be disposed between the trailing carton 305A and the leading carton 305.

Figure 11:
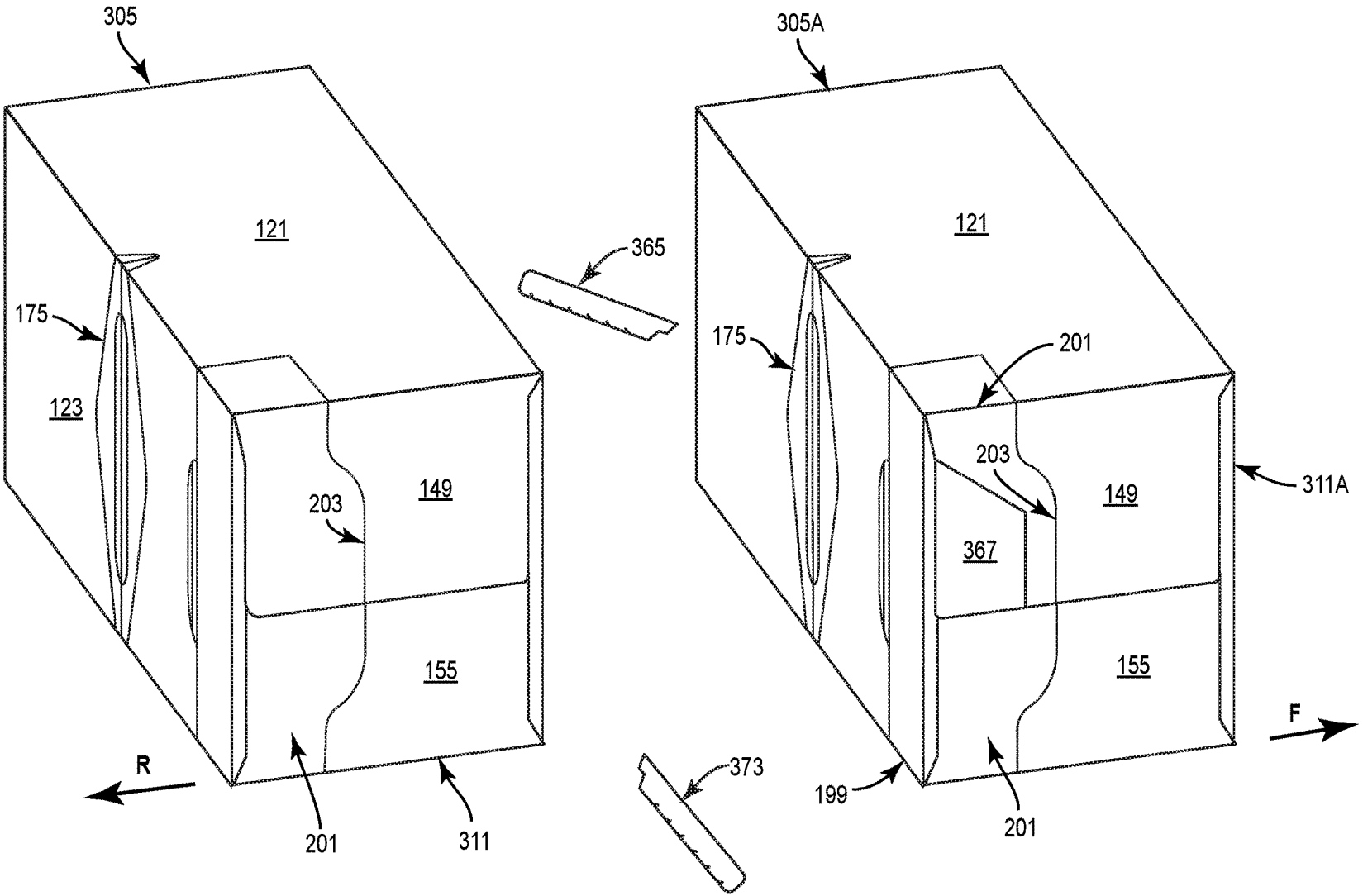
FIG. 11 is a perspective view of the cartons of the system of FIG. 10 being separated from one another.

With additional reference to FIG. 11, one or more of the constituent cartons 305, 305A of the system 313 can be separated therefrom via the tearing features of the respective carton 305, 305A as described above with respect to the system 113. For example, and as shown, the tear strips 365, 373 of a trailing carton 305 can be removed, e.g., by tearing along the respective tear lines 361, 363 and tear lines 369, 371 such that the attachment flaps 359, 367 remain attached to the respective ends 309A, 311A of a leading carton 305A or to the respective ends 309, 311 of a forwardly-adjacent carton 305 such that the cartons attached across the tear strips 365, 373 can thereby be separated from one another.

It will be understood that the system 313 can be separated in a different arrangement, for example, by tearing at one of the respective pair of tear lines 361, 363 and tear lines 369, 371, such that the respective tear strip 365, 373 remains attached to the respective attachment flap 359, 367 or to the respective top end flap 139, 149 of the leading carton 305.

Figure 12:
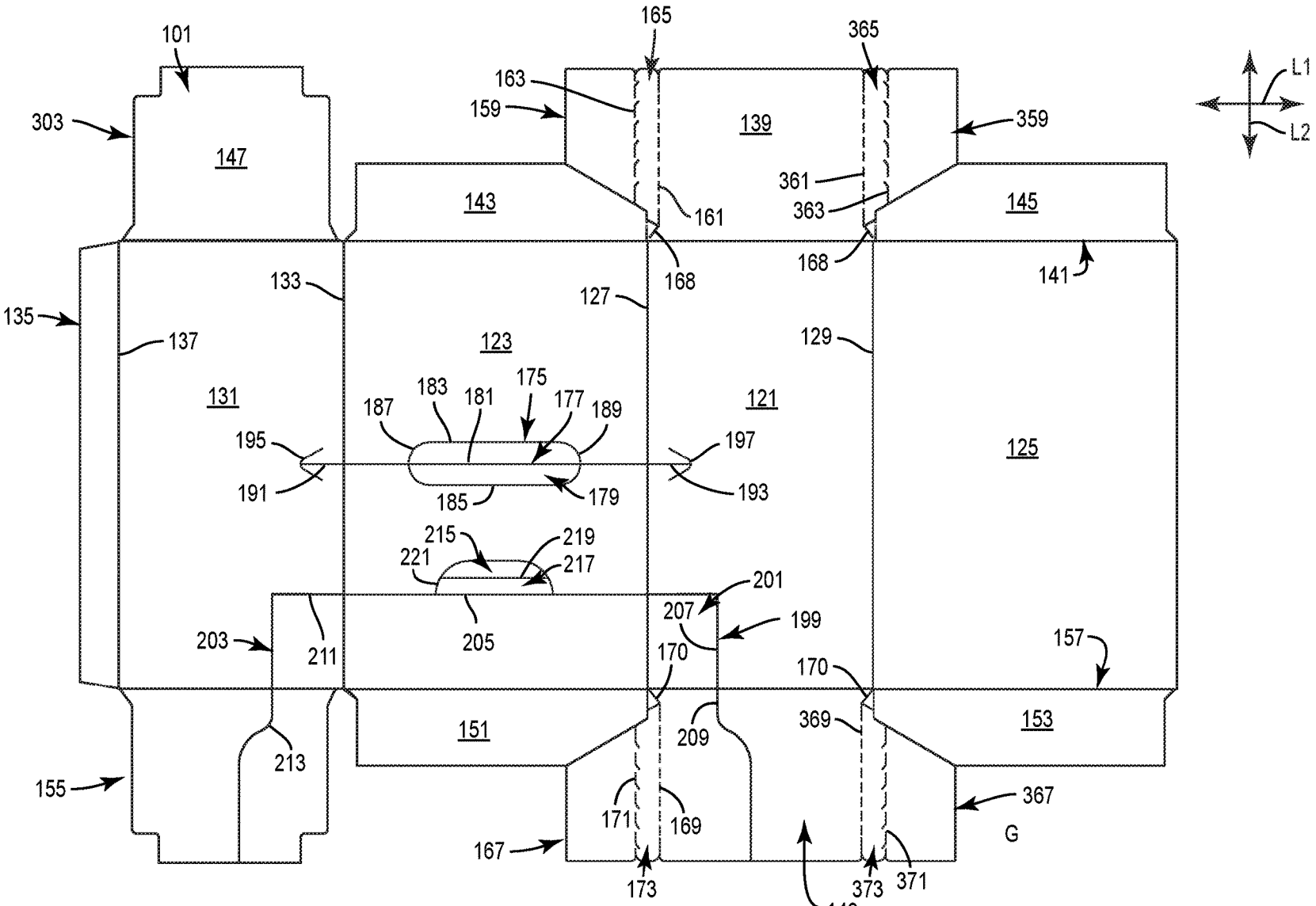
FIG. 12 is a plan view of a blank for forming a carton according to a third exemplary embodiment of the disclosure.

Referring additionally to FIG. 12, a blank for forming a carton 405 (broadly, "first carton") according to a third exemplary embodiment of the disclosure is generally designated 403. The blank 403/carton 405 has one or more features that are substantially similar to the blank 103/carton 105 of the first exemplary embodiment and the blank 303/carton 305 of the second exemplary embodiment, and like or similar features are designated with like or similar reference numbers.

As shown, the blank 303, in contrast to the blanks 103, 303, includes both the attachment flaps 159, 359, (broadly, respective "first attachment flap" or "second attachment flap") and attachment flaps 167, 367 (broadly, "first attachment flap" or "second attachment flap") that are removably connected to the respective top end flaps 139, 149 at the respective tear lines 161, 361 and tear lines 169, 369. Tear lines 163, 363 and tear lines 171, 371 are spaced apart from the respective tear lines 161, 361 and tear lines 169, 369 to define the respective tear strips 165, 365, and tear strips 173, 373 therebetween.

Figure 13:
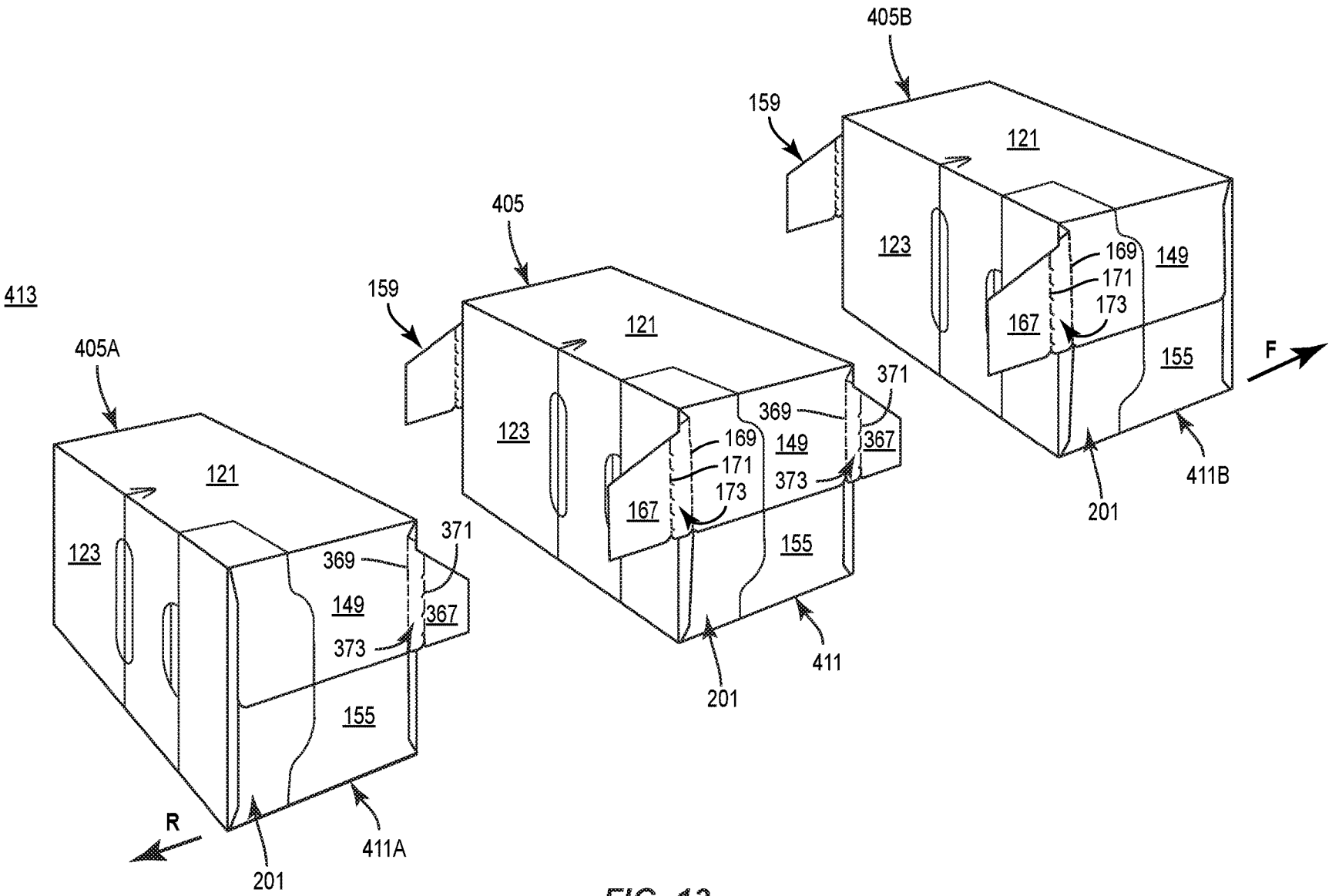
FIG. 13 is a perspective view of a carton formed from the blank of FIG. 12 alongside an alternative configuration of the carton formed from the blank of FIG. 12, alongside another alternative configuration of the carton formed from the blank of FIG. 12, according to the third exemplary embodiment of the disclosure.

In this regard, and with additional reference to FIG. 13, the carton 405 can be formed from the blank 403 in a manner similar to that described above with respect to the carton 105 and the blank 103 as well as the carton 305 and the blank 303, and such that the respective closed ends 409, 411 (broadly, respective "first closed end" or "second closed end") of the carton 405 are formed with the respective attachment flaps 159, 359 and 167, 367 extending longitudinally away therefrom in opposing longitudinal directions, i.e., the leading direction F and the trailing direction R.

Similarly, a trailing carton 405A (broadly, "second carton" or "third carton") can be formed by folding the respective attachment flaps 159, 167 at one of the respective fold lines 161, 163 and fold lines 169, 171 to be tucked under the respective top end flaps 139, 149 as described above with respect to the carton 105A, and a leading carton 405B (broadly, "second carton" or "third carton") can be formed by folding the respective attachment flaps 359, 367 at one of the respective fold lines 361, 363 and fold lines 369, 371 to be tucked under the respective top end flaps 139, 149 as described above with respect to the carton 305A.

Figure 14:
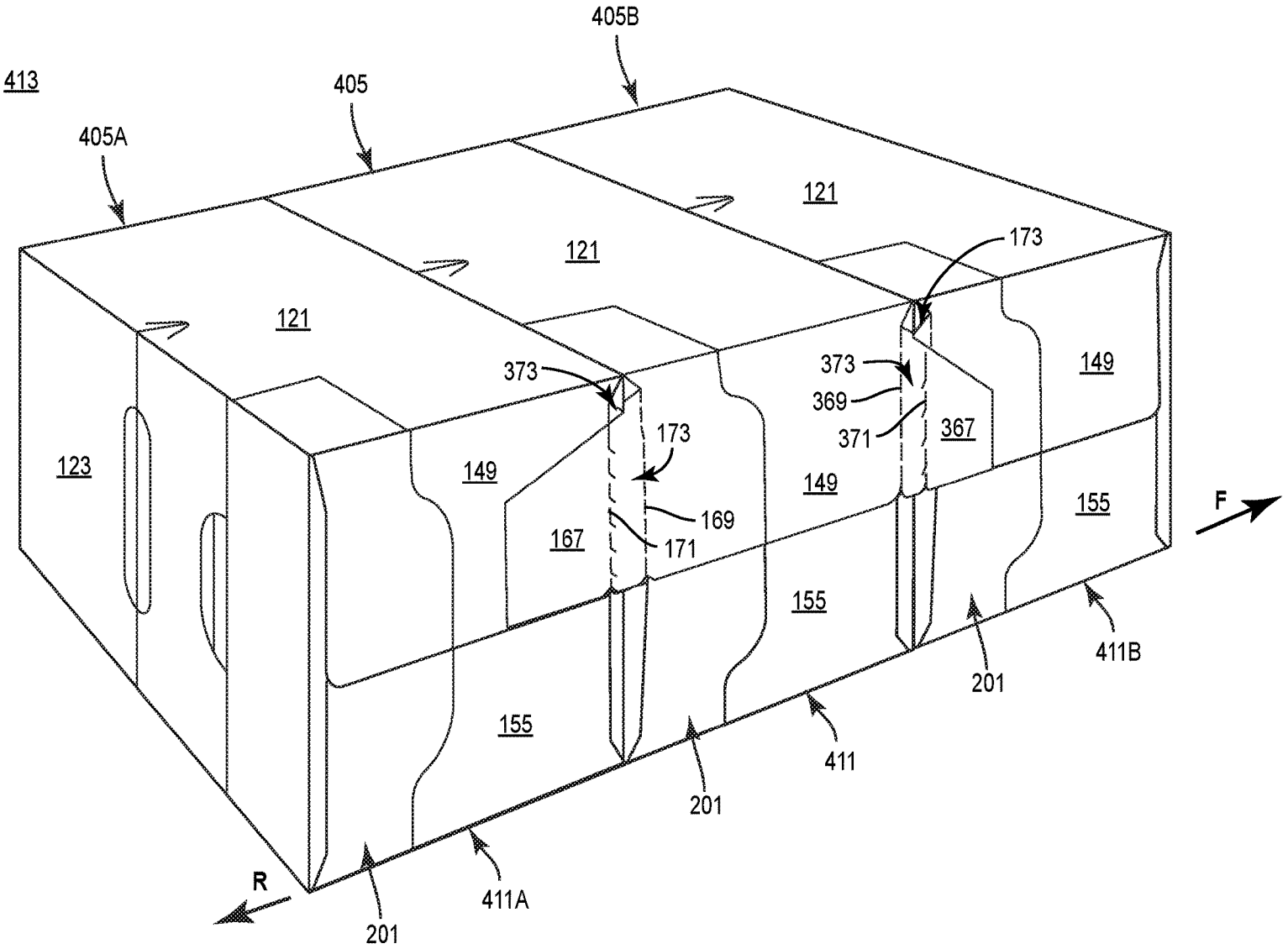
FIG. 14 is a perspective view of a system including the attached cartons of FIG. 13.
Figure 15:
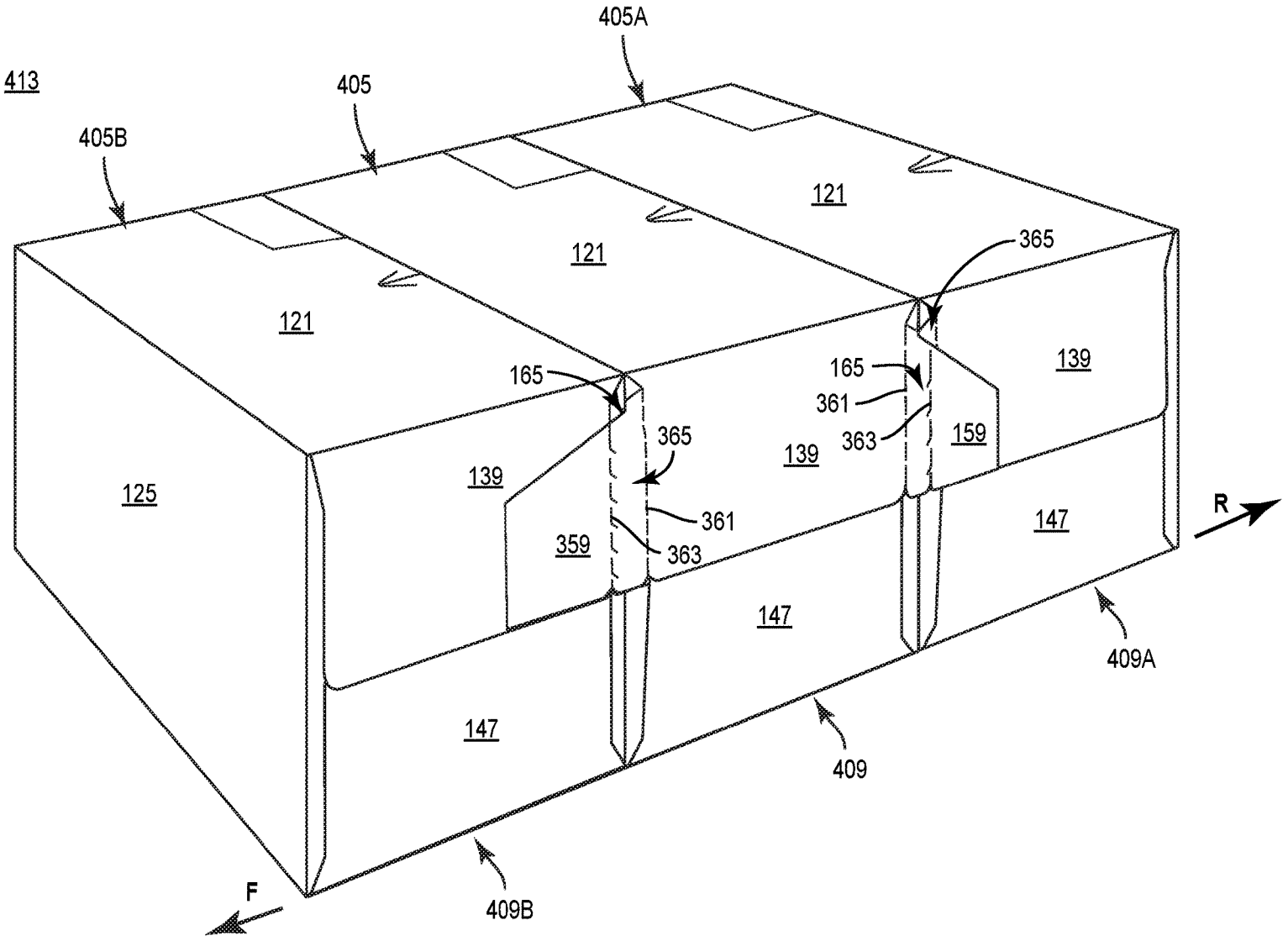
FIG. 15 is another perspective view of the system of FIG. 14.

Accordingly, a multipack or a system 413 of cartons 405A, 405, 405B is illustrated in FIGS. 14 and 15 according to one exemplary embodiment of the disclosure. In the system 413, the carton 405A can be positioned as a rear-most or trailing carton with a substantially compact main body, the carton 405B can be positioned as a forward-most or leading carton with a substantially compact main body, and one or more cartons 405 are attached therebetween to provide the respective longitudinally-rearward and longitudinally-forward extending attachment flaps 359, 367 and attachment flaps 159, 167 that can be attached to the respective ends 409B, 411B and ends 409A, 411A of a respective adjacent carton 405A, 405B or the respective ends 409, 411 of another adjacent carton 405, e.g., a portion of a respective top end flap 139, 149.

In this regard, in one embodiment, one or both of respective overlapping pairs of tear strips 165, 365 and tear strips 173, 373 can be provided in a two-ply configuration to provide additional/reinforced attachment between adjacent cartons. For example, because respective tear strips 165, 365 and tear strips 173, 373 can be overlapped in the above-described arrangements, additional forces may be required to separate adjacent cartons at the respective overlapped tear features, e.g., one or both of the overlapped tear lines 161, 361, tear lines 163, 363, tear lines 169, 369, and tear lines 171, 371. As described above, the respective attachment flaps 159, 167, 359, 367 can be attached to an exterior surface or an exterior surface of a respective end of a respective adjacent carton.

While a system 413 has been illustrated as comprising a trailing carton 405A attached to a carton 405 that is attached to a leading carton 405B, it will be understood that the system 413 can include a different number or arrangement of cartons without departing from the disclosure. For example, one or more additional cartons 405 can be attached between the trailing carton 405A and the leading carton 405B. In one embodiment, one or more differently-configured cartons can be disposed between the trailing carton 405A and the leading carton 405B.

Furthermore, it will be understood that cartons can be provided as leading and trailing cartons in the system 413 other than by modifying cartons 405. For example, a carton 105 or a carton 305 could be provided as such leading and trailing cartons. In one embodiment, one or both of the leading carton and the trailing carton could be a carton devoid of attachment features.

Figure 16:
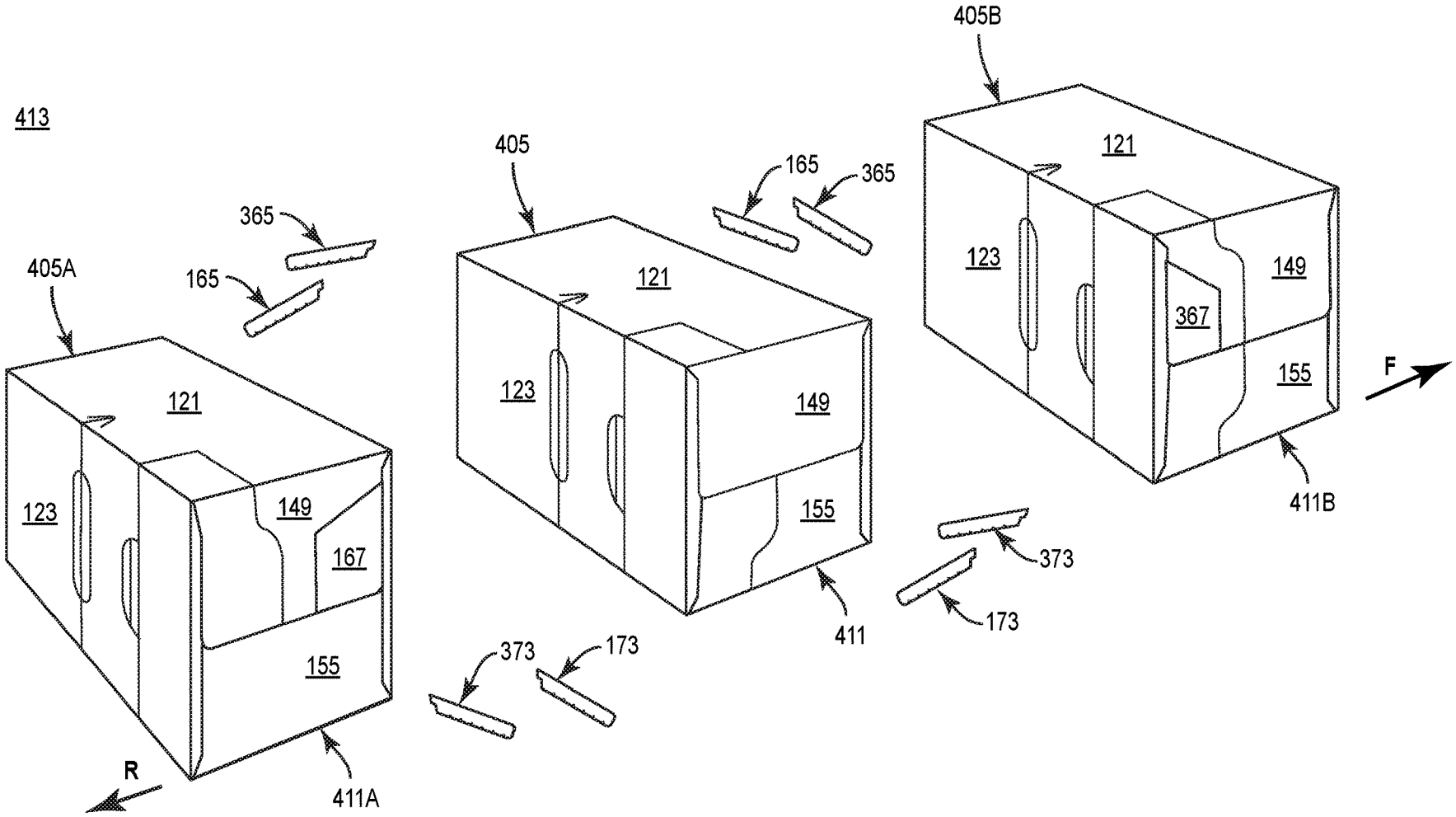
FIG. 16 is a perspective view of the cartons of the system of FIG. 14 being separated from one another.

One or more of the constituent cartons 405A, 405, 405B of the system 413 can be separated therefrom via the tearing features of the respective carton 405A, 405, 405B as described above with respect to the systems 113, 313. For example, and as shown in FIG. 16, the tear strips 165, 173 of a carton 405 can be removed, e.g., by tearing along the respective tear lines 161/163 and tear lines 169/171 such that the respective attachment flaps 167, 159 remain attached to the respective ends 411A, 409A of the trailing carton 405A to separate the cartons 405A, 405 from one another.

It will be understood that the attachment flaps 367, 359 of the trailing carton 405A can remain attached to an interior surface of the respective top end flaps 149, 139 of the respective carton 405, or, in one embodiment, the attachment flaps 367, 359 and the respective tear strips 373, 365 can remained tucked in the respective ends 411A, 409A of the trailing carton 405A.

Similarly, and as shown, the tear strips 365, 373 of the carton 405 can be removed by tearing along the tear lines 361/363 and tear lines 369/371 such that the attachment flaps 359, 367 remain attached to the respective ends 409A, 411A of the leading carton 405A so that that the cartons 405, 405B can thereby be separated from one another. It will be understood that the system 313 can be separated in a different arrangement, for example, in which a respective tear strip 165, 173, 365, 373 is separated along a single tear line 161, 163, 361, 363, 169, 171, 369, 371, as described above.

It will be understood that the attachment flaps 167, 159 of the leading carton 405B can remain attached to an interior surface of the respective top end flaps 149, 139 of the respective carton 405, or, in one embodiment, the attachment flaps 167, 159 and the respective tear strips 173, 165 can remained tucked in the respective ends 411B, 409B of the leading carton 405B.

The foregoing systems 113, 313, 413 are provided with integral attachment features via which multiple respective cartons can be attached to one another without the need for additional accessories for bundling or attaching multiple cartons, e.g., plastic overwraps or sheets, additional outer container structures, bands or straps, etc. In this regard, significant material savings can be provided by the configurations of the systems 113, 313, 413 and cartons 105/105A, 305, 305A, 405/405A/405B disclosed herein, while also providing a robust structure for attaching the cartons. Furthermore, such systems can be provided with the separation features so that customization of the systems 113, 313, 413, e.g., the ability to remove a desired one or more respective cartons from a respective system, is provided to a customer.

It will be understood that one or more of the blanks 103, 303, 403 and the respective cartons 105/105A, 305/305A, 405/405A/405B can have a different configuration without departing from the disclosure. For example, in one embodiment, one or more of the blanks and the cartons formed therefrom described herein can be devoid of one or more of the lines of weakening 196, 198.

Any of the features of the various embodiments of the disclosure can be combined with, replaced by, or otherwise configured with other features of other embodiments of the disclosure without departing from the scope of this disclosure. Further, it is noted that the nesting arrangements and/or the features of the blanks and cartons of the various embodiments can be incorporated into a carton or blank having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

As described herein, a line of weakening can refer to any one or a combination of a fold line and a tear line as described above.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels extending at least partially around an interior of the carton, the plurality of panels comprising a top panel, a bottom panel, and at least one side panel;

a plurality of end flaps foldably connected to a respective panel of the plurality of panels and forming at least one closed end of the carton, the plurality of end flaps comprising at least one top end flap, at least one bottom end flap, and at least one side end flap; and attachment features for attaching the carton to at least one other carton, the attachment features comprising at least one attachment flap removably connected to an end flap of the plurality of end flaps for attaching the carton to a portion of the at least one other carton, the at least one attachment flap for being positioned in at least partial face-to-face contact with the portion of the at least one other carton.

2. The carton of claim 1, further comprising separation features for separating the at least one attachment flap from the end flap of the plurality of end flaps.

3. The carton of claim 2, wherein the separation features comprise a tear line between the at least one attachment flap and the end flap of the plurality of end flaps.

4. The carton of claim 3, wherein the tear line is a first tear line, and the separation features comprise a second tear line spaced away from the first tear line to define a tear strip between the first tear line and the second tear line.

5. The carton of claim 4, wherein the at least one attachment flap is removably connected to the tear strip at the second tear line, and the tear strip is removably connected to the at least one top end flap at the first tear line.

6. The carton of claim 2, wherein the at least one closed end of the carton is a first closed end of the carton, the at least one top end flap is a first top end flap extending away from the first closed end of the carton, the at least one attachment flap is a first attachment flap foldably connected to the first top end flap, the plurality of end flaps further comprises a second top end flap foldably connected to the top panel and at least partially forming a second closed end of the carton, and the attachment features further comprise a second attachment flap removably connected to the second top end flap and extending away from the second closed end of the carton.

7. The carton of claim 1, wherein the at least one attachment flap extends away from the at least one closed end of the carton.

8. The carton of claim 7, wherein the at least one attachment flap is for being adhered to the portion of the at least one other carton.

9. The carton of claim 1, wherein the carton comprises a dispenser in the at least one closed end of the carton.

10. The carton of claim 9, wherein the dispenser comprises a dispenser panel defined by a plurality of tear lines extending in at least one of the top panel, the at least one side panel, and the at least one bottom panel.

11. The carton of claim 10, wherein the dispenser panel comprises at least a portion of each of the top panel, the at least one side panel, the at least one bottom panel, and the at least one top end flap.

12. The carton of claim 11, wherein the at least one attachment flap extends away from the at least one closed end of the carton.

13. A blank for forming a carton for holding a plurality of containers, the blank comprising:

a plurality of panels for extending at least partially around an interior of the carton formed from the blank, the plurality of panels comprising a top panel, a bottom panel, and at least one side panel;

a plurality of end flaps foldably connected to a respective panel of the plurality of panels and for forming at least one closed end of the carton formed from the blank, the plurality of end flaps comprising at least one top end flap, at least one bottom end flap, and at least one side end flap; and attachment features for removably connecting the carton formed from the blank to at least one other carton, the attachment features comprising at least one attachment flap removably connected to an end flap of the plurality of end flaps for attaching the carton formed from the blank to a portion of the at least one other carton, the at least one attachment flap for being positioned in at least partial face-to-face contact with the portion of the at least one other carton.

14. The blank of claim 13, further comprising separation features for separating the at least one attachment flap from the end flap of the plurality of end flaps.

15. The blank of claim 14, wherein the separation features comprise a tear line between the at least one attachment flap and the end flap of the plurality of end flaps.

16. The blank of claim 15, wherein the tear line is a first tear line, and the separation features comprise a second tear line spaced away from the first tear line to define a tear strip between the first tear line and the second tear line.

17. The blank of claim 16, wherein the at least one attachment flap is removably connected to the tear strip at the second tear line, and the tear strip is removably connected to the at least one top end flap at the first tear line.

18. The blank of claim 14, wherein the at least one closed end of the carton formed from the blank is a first closed end of the carton formed from the blank, the at least one top end flap is a first top end flap for extending away from the first closed end of the carton formed from the blank, the at least one attachment flap is a first attachment flap foldably connected to the first top end flap, the plurality of end flaps further comprises a second top end flap foldably connected to the top panel and for at least partially forming a second closed end of the carton formed from the blank, and the attachment features further comprise a second attachment flap removably connected to the second top end flap and for extending away from the second closed end of the carton formed from the blank.

19. The blank of claim 13, wherein the blank comprises dispenser features for forming a dispenser in the at least one closed end of the carton formed from the blank, the dispenser features comprise a dispenser panel defined by a plurality of tear lines extending in at least one of the top panel, the at least one side panel, and the at least one bottom panel.

20. The blank of claim 19, wherein the dispenser panel comprises at least a portion of each of the top panel, the at least one side panel, the at least one bottom panel, and the at least one top end flap.

21. A method of forming a carton for holding a plurality of containers, the method comprising:

obtaining a blank comprising a plurality of panels comprising a top panel, a bottom panel, and at least one side panel, a, plurality of end flaps comprising at least one top end flap, at least one bottom end flap, and at least one side end flap, and attachment features comprising at least one attachment flap removably connected to an end flap of the plurality of end flaps;

folding the plurality of panels at least partially around an interior of the blank;

folding the plurality of end flaps to form at least one closed end of the carton; and attaching the at least one attachment flap to a portion of at least one other carton such that the at least one attachment flap is in at least partial face-to-face contact with the portion of the at least one other carton.

22. The method of claim 21, further comprising separation features for separating the at least one attachment flap from the end flap of the plurality of end flaps.

23. The method of claim 22, wherein the separation features comprise a tear line between the at least one attachment flap and the end flap of the plurality of end flaps.

24. The method of claim 23, wherein the tear line is a first tear line, and the separation features comprise a second tear line spaced away from the first tear line to define a tear strip between the first tear line and the second tear line.

25. The method of claim 24, wherein the at least one attachment flap is removably connected to the tear strip at the second tear line, and the tear strip is removably connected to the at least one top end flap at the first tear line.

26. The method of claim 22, wherein the at least one closed end of the carton is a first closed end of the carton, the at least one top end flap is a first top end flap extending away from the first closed end of the carton, the at least one attachment flap is a first attachment flap foldably connected to the first top end flap, the plurality of end flaps further comprises a second top end flap foldably connected to the top panel and at least partially forming a second closed end of the carton, and the attachment features further comprise a second attachment flap removably connected to the second top end flap and extending away from the second closed end of the carton.

27. The method of claim 21, wherein the at least one attachment flap extends away from the at least one closed end of the carton.

28. The method of claim 27, wherein the at least one attachment flap is for being adhered to the portion of the at least one other carton.

29. The method of claim 21, wherein the carton comprises a dispenser in the at least one closed end of the carton.

30. The method of claim 29, wherein the dispenser comprises a dispenser panel defined by a plurality of tear lines extending in at least one of the top panel, the at least one side panel, and the at least one bottom panel.

31. The method of claim 30, wherein the dispenser panel comprises at least a portion of each of the top panel, the at least one side panel, the at least one bottom panel, and the at least one top end flap.

32. The method of claim 31, wherein the at least one attachment flap extends away from the at least one closed end of the carton.

33. A system of cartons for holding a plurality of containers; the system comprising:

a first carton attached to a second carton, the first carton comprising:

a plurality of panels extending at least partially around an interior of the first carton, the plurality of panels comprising a top panel, a bottom panel, and at least one side panel;

a plurality of end flaps foldably connected to a respective panel of the plurality of panels and forming at least one closed end of the first carton, the plurality of end flaps comprising at least one top end flap, at least one bottom end flap, and at least one side end flap; and attachment features removably connecting the first carton to the second carton, the attachment features comprising at least one attachment flap removably connected to an end flap of the plurality of end flaps of the first carton and attached to a portion of the second carton such that the at least one attachment flap is in at least partial face-to-face contact with the portion of the second carton.

34. The system of claim 33, further comprising separation features for separating the at least one attachment flap from the end flap of the plurality of end flaps of the first carton.

35. The system of claim 34, wherein the separation features comprise a tear line between the at least one attachment flap and the end flap of the plurality of end flaps of the first carton.

36. The system of claim 35, wherein the tear line is a first tear line, and the separation features comprise a second tear line spaced away from the first tear line to define a tear strip between the first tear line and the second tear line of the first carton.

37. The system of claim 36, wherein the at least one attachment flap is removably connected to the tear strip at the second tear line, and the tear strip is removably connected to the at least one top end flap at the first tear line.

38. The system of claim 34, wherein the at least one closed end of the first carton is a first closed end of the first carton, the at least one top end flap is a first top end flap extending away from the first closed end of the first carton, the at least one attachment flap is a first attachment flap foldably connected to the first top end flap, the plurality of end flaps further comprises a second top end flap foldably connected to the top panel and at least partially forming a second closed end of the first carton, and the attachment features further comprise a second attachment flap removably connected to the second top end flap and extending away from the second closed end of the first carton.

39. The system of claim 33, wherein the at least one attachment flap extends away from the at least one closed end of the first carton.

40. The system of claim 39, wherein the at least one attachment flap of the first carton is for being adhered to the portion of the second carton.

41. The system of claim 33, wherein the first carton comprises a dispenser in the at least one closed end of the first carton.

42. The system of claim 41, wherein the dispenser of the first carton comprises a dispenser panel defined by a plurality of tear lines extending in at least one of the top panel, the at least one side panel, and the at least one bottom panel.

43. The system of claim 42, wherein the dispenser panel comprises at least a portion of each of the top panel, the at least one side panel, the at least one bottom panel, and the at least one top end flap.

44. The system of claim 43, wherein the at least one attachment flap extends away from the at least one closed end of the first carton.

45. The system of claim 33, further comprising a third carton attached to the first carton, and wherein the at least one attachment flap is a first attachment flap of the first carton, and the first carton further comprises a second attachment flap removably connected to the end flap of the plurality of end flaps of the first carton and attached to a portion of the third carton.

* * * * *